US010883306B2

(12) United States Patent
Massey

(10) Patent No.: US 10,883,306 B2
(45) Date of Patent: Jan. 5, 2021

(54) FENESTRATION TRIM ASSEMBLY

(71) Applicant: Milgard Manufacturing Incorporated, Tacoma, WA (US)

(72) Inventor: Victor Massey, Orting, WA (US)

(73) Assignee: MILGARD MANUFACTURING LLC, Wilmington, DE (US)

( * ) Notice: Subject to any disclaimer, the term of this patent is extended or adjusted under 35 U.S.C. 154(b) by 58 days.

(21) Appl. No.: 16/118,653

(22) Filed: Aug. 31, 2018

(65) Prior Publication Data

US 2019/0128052 A1 May 2, 2019

Related U.S. Application Data

(62) Division of application No. 14/778,275, filed as application No. PCT/US2014/034014 on Apr. 14, 2014, now Pat. No. 10,094,164.

(60) Provisional application No. 61/811,725, filed on Apr. 13, 2013.

(51) Int. Cl.

| | |
|---|---|
| ***E06B 3/964*** | (2006.01) |
| ***E06B 3/968*** | (2006.01) |
| ***E06B 1/34*** | (2006.01) |
| ***E06B 3/96*** | (2006.01) |

(52) U.S. Cl.

CPC ..... *E06B 3/9688* (2013.01); *E06B 1/34* (2013.01); *E06B 3/9632* (2013.01); *E06B 3/9642* (2013.01); *E06B 3/9644* (2013.01); *E06B 3/9646* (2013.01); *E06B 3/9641* (2013.01); *E06B 3/9643* (2013.01); *E06B 3/9645* (2013.01)

(58) Field of Classification Search

CPC ..... E06B 1/34; E06B 3/9632; E06B 3/9641; E06B 3/9642; E06B 3/9643; E06B 3/9644; E06B 3/9645; E06B 3/9646; E06B 3/9688; E06B 1/28

USPC .... 52/656.9, 204.2, 207, 210, 211, 212, 213

See application file for complete search history.

(56) References Cited

U.S. PATENT DOCUMENTS

| | | | | | |
|---|---|---|---|---|---|
| 2,788,097 | A | * | 4/1957 | Frick | E05D 15/0665 52/207 |
| 3,778,175 | A | * | 12/1973 | Zimmer | B62D 33/044 403/187 |
| 3,782,054 | A | | 1/1974 | Goss | |
| 4,899,507 | A | * | 2/1990 | Mairlot | B32B 17/10036 52/222 |
| 5,119,872 | A | | 6/1992 | Engebretson | |
| 5,431,211 | A | | 7/1995 | Guillemet | |
| 5,493,800 | A | | 2/1996 | Chinitz | |
| 5,494,370 | A | * | 2/1996 | Habicht | E06B 3/9642 403/403 |
| 6,141,925 | A | * | 11/2000 | Halvorson, Jr. | E04B 2/7455 52/126.3 |

(Continued)

FOREIGN PATENT DOCUMENTS

| | | |
|---|---|---|
| EP | 0719373 B1 | 6/1999 |
| EP | 2246513 A2 | 11/2010 |

OTHER PUBLICATIONS

International Search Report and Written Opinion for PCT/US2014/034014; dated Sep. 8, 2014; 10 pages.

*Primary Examiner* — Brian E Glessner
*Assistant Examiner* — James J Buckle, Jr.
(74) *Attorney, Agent, or Firm* — Rathe Lindenbaum LLP

(57) ABSTRACT

A corner key for a fenestration trim assembly includes a sloped bearing surface configured to bias a first lineal toward a second lineal about the longitudinal axis of the second lineal.

13 Claims, 40 Drawing Sheets

(56) References Cited

U.S. PATENT DOCUMENTS 6,637,158 B2 * 10/2003 Bennett ..... E06B 1/524 49/471
6,763,639 B2 * 7/2004 Bennett ..... E06B 1/6092 160/92
6,881,005 B2 * 4/2005 Sosa ..... E06B 3/964 256/65.05
7,509,780 B2 3/2009 Leontaridis
7,806,620 B1 10/2010 Brochez
8,033,076 B2 * 10/2011 Plagemann ..... B29C 70/52 52/653.1
8,327,596 B2 * 12/2012 Bratton ..... E04B 1/28 52/481.1
8,615,944 B2 12/2013 Maziarz
8,851,787 B2 * 10/2014 Kelley ..... B29C 65/542 403/402
8,919,056 B2 * 12/2014 Rochman ..... E06B 1/32 52/204.1
8,966,839 B2 * 3/2015 Rebman ..... E06B 3/28 52/202
9,528,315 B2 12/2016 Kim
9,718,235 B2 * 8/2017 Kelley ..... B29C 65/542
9,869,122 B2 * 1/2018 Isaacs ..... E06B 1/12
2003/0106269 A1 * 6/2003 Bauman ..... E06B 3/9632 49/467
2004/0035082 A1 2/2004 Hudoba et al.
2005/0115178 A1 * 6/2005 Schmidt ..... E06B 3/9641 52/272
2006/0059843 A1 3/2006 Leontaridis
2007/0137134 A1 * 6/2007 Plagemann ..... E04C 3/28 52/656.9
2008/0271394 A1 * 11/2008 Hand ..... E06B 1/02 52/210
2011/0194886 A1 * 8/2011 Wu ..... E06B 3/9641 403/23
2012/0110936 A1 5/2012 Egan et al.
2012/0279166 A1 11/2012 Valler et al.
2013/0111847 A1 5/2013 Emanuel
2013/0205696 A1 8/2013 Little et al.
2013/0205706 A1 8/2013 Beranek
2014/0053479 A1 2/2014 Valler et al.
2014/0064844 A1 3/2014 Massey
2014/0102018 A1 * 4/2014 Rochman ..... E06B 1/32 52/210
2014/0360124 A1 12/2014 Kim
2015/0121788 A1 5/2015 Kim

* cited by examiner

FIG. 23
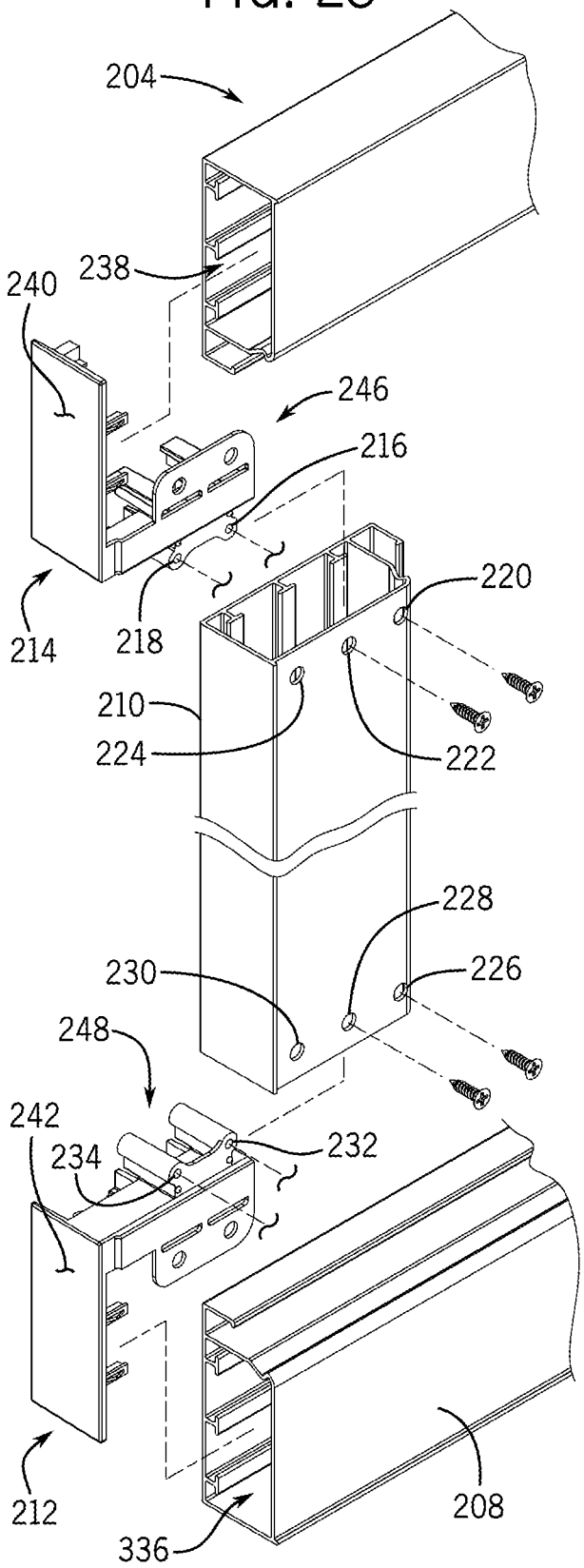
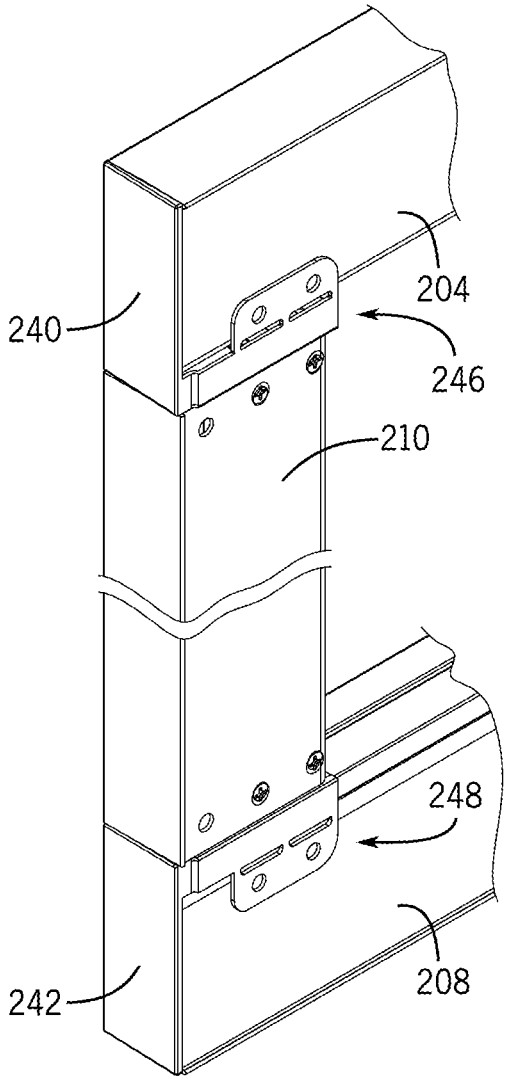
FIG. 24

FIG. 33
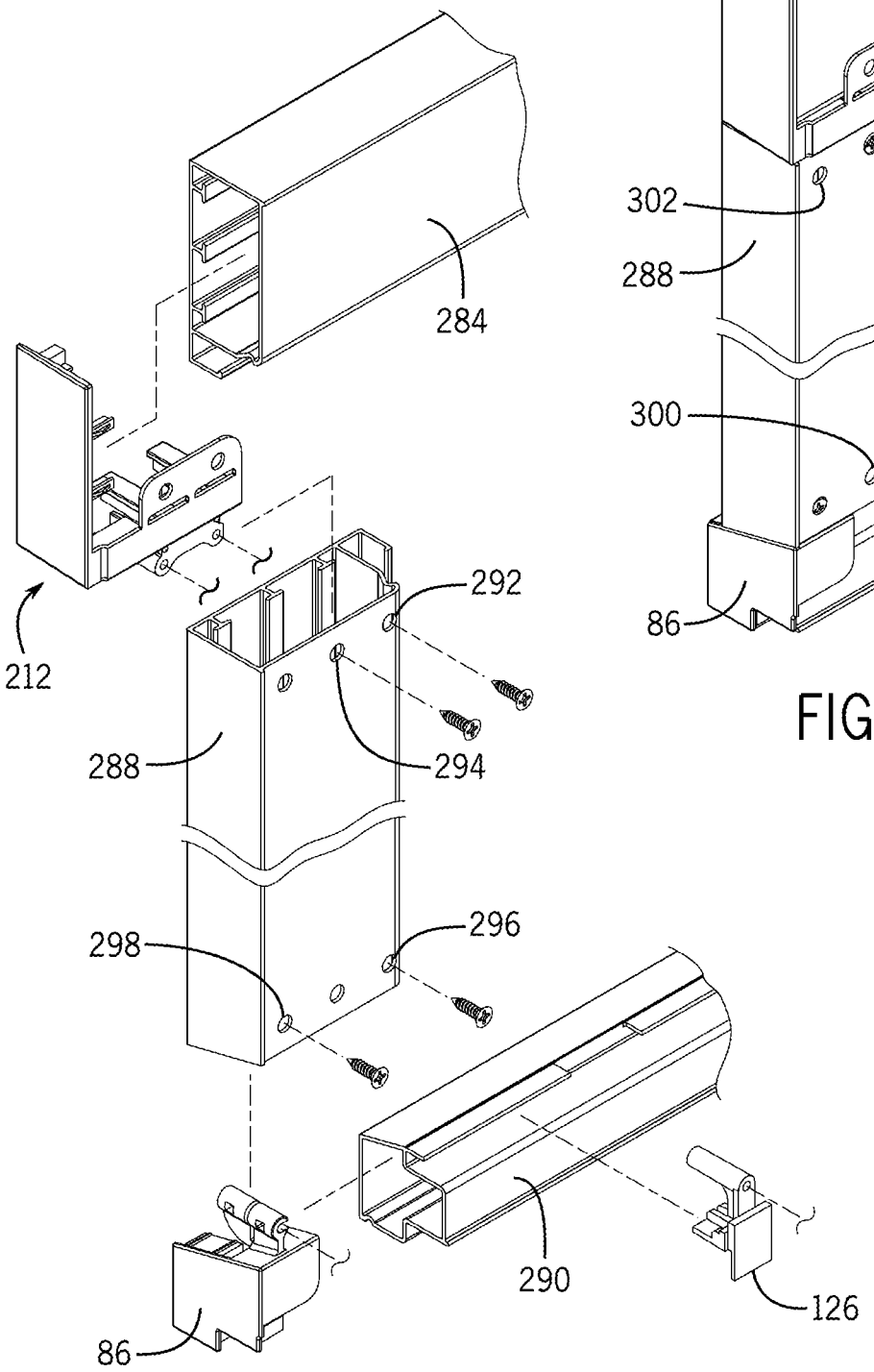
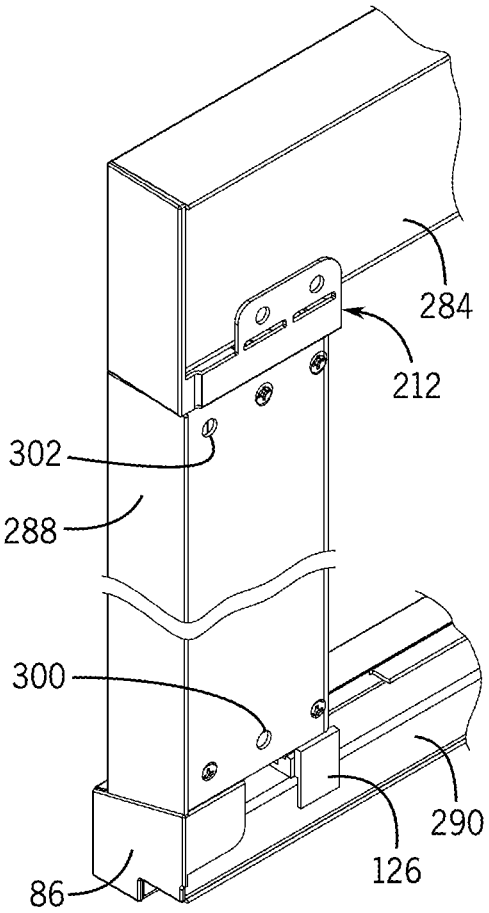
FIG. 34

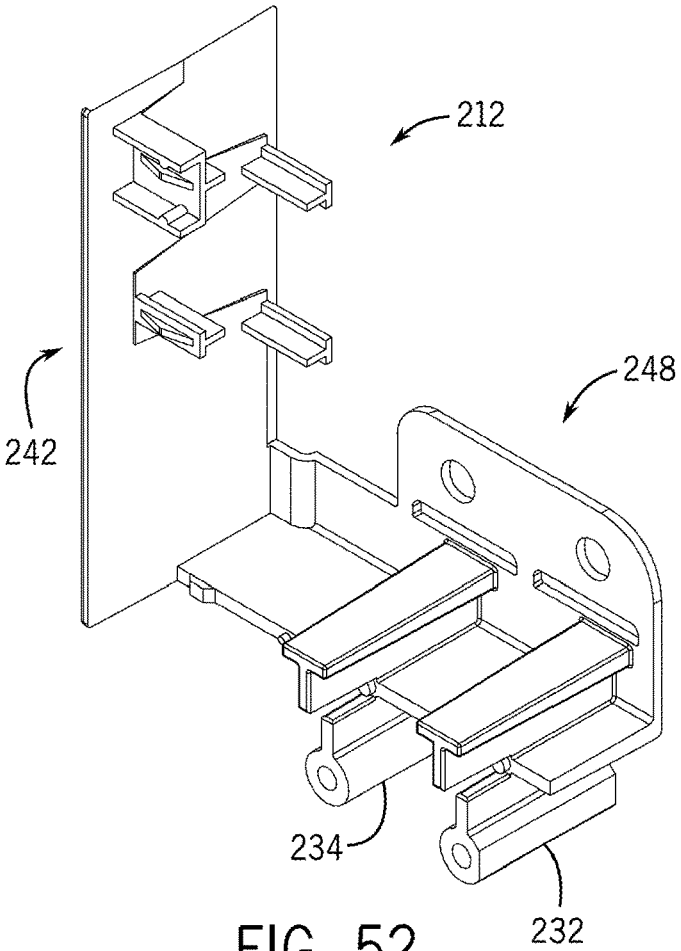
FIG. 52
FIG. 53
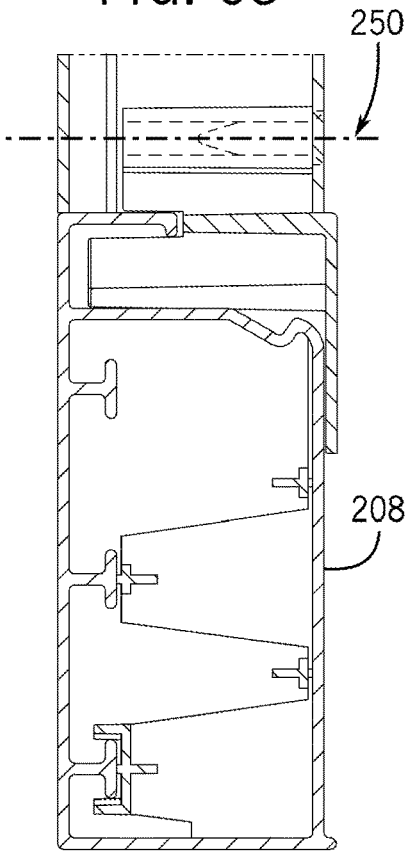
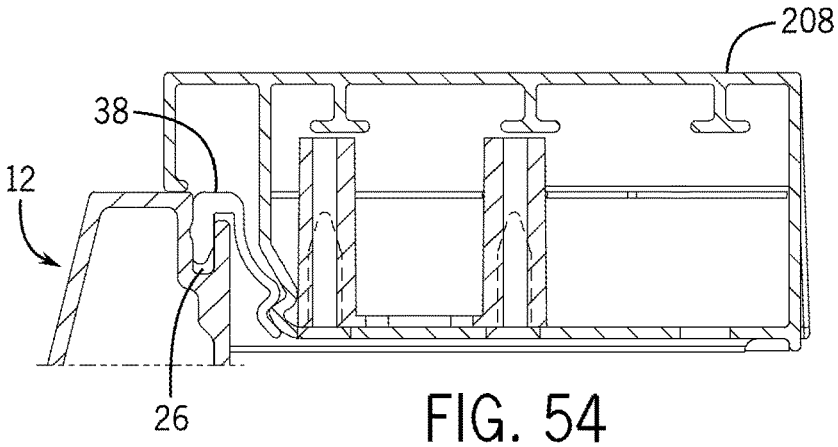
FIG. 54

FIG. 68
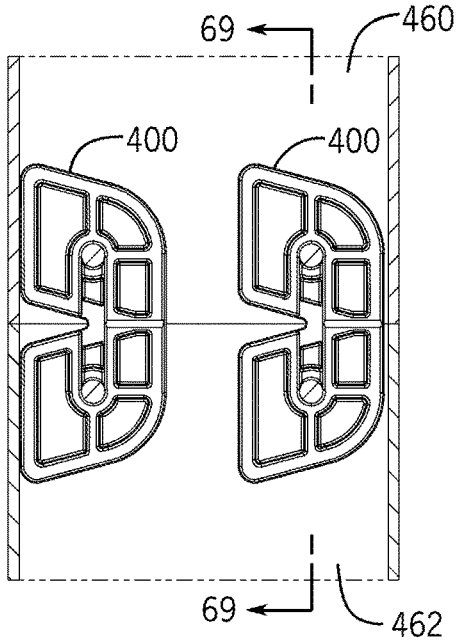
FIG. 67
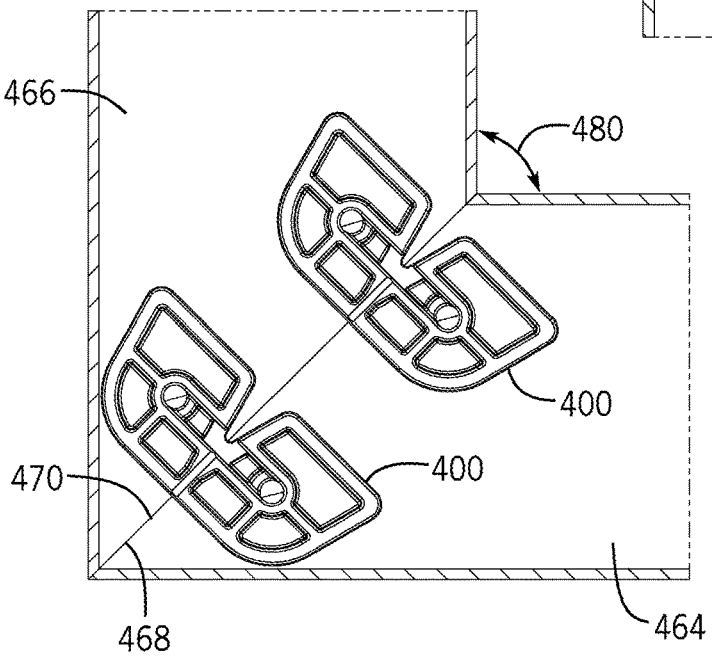
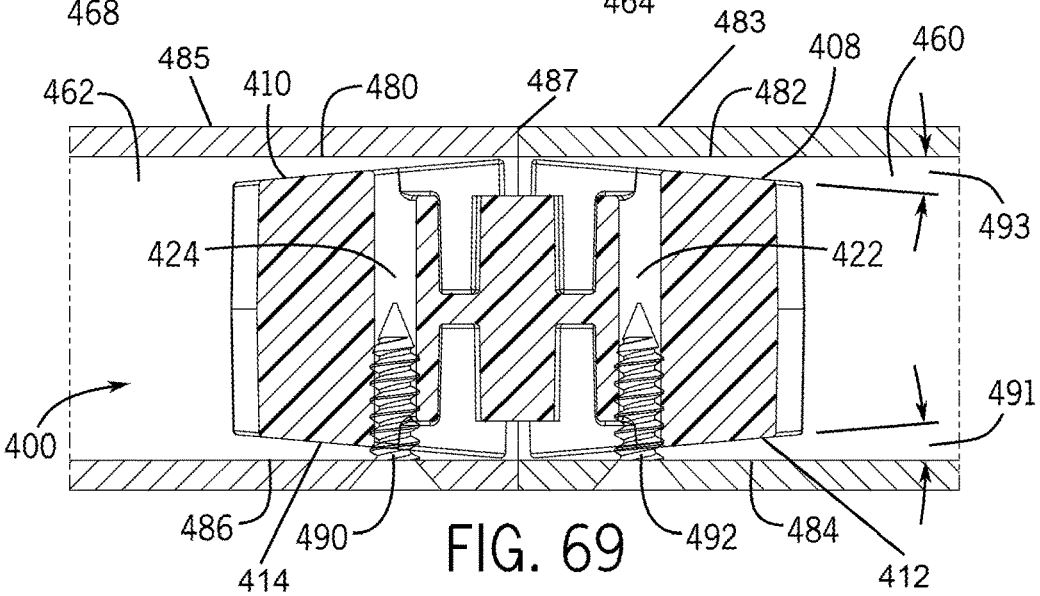
FIG. 69

FENESTRATION TRIM ASSEMBLY

CROSS-REFERENCE TO RELATED PATENT APPLICATIONS

This application is a divisional of U.S. patent application Ser. No. 14/778,275 entitled FENESTRATION TRIM ASSEMBLY filed Sep. 18, 2015, which is a national stage application of International Application No. PCT/US2014/034014 entitled FENESTRATION TRIM ASSEMBLY filed Apr. 14, 2014, which claims the benefit of U.S. Provisional Application No. 61/811,725 entitled TRIM SYSTEM filed on Apr. 13, 2013 all of which are incorporated herein by reference in their entireties.

BACKGROUND OF THE INVENTION

Trim is used in a variety of building applications to frame architectural elements of a building. Trim may be sued to finish and surround doorways, windows, patio doors, garage doors and other types of architectural elements that define openings to a building structure. Trim is applied to frame the architectural elements windows on site and may be secured with tools and fasteners such as a hammer and nails.

SUMMARY OF THE INVENTION

A fenestration trim assembly includes a trim frame including at least a first lineal member and a second lineal member, each lineal member having a hollow interior. A corner key operatively couples the first lineal member to the second lineal member. The corner key having a sloped bearing surface.

In a further aspect of one embodiment the corner key includes a center line and a first leg that operatively received within the hollow interior of the first lineal member, and a second leg that is operatively received within the hollow interior of the second lineal member. The bearing surface having a slope away from the center line.

In one embodiment, a corner key has a sloped bearing surface configured to bias a first member toward a second member about a vector parallel to a longitudinal axis of one the first and second lineal members.

In another embodiment, a fenestration trim assembly includes a first lineal member having a first longitudinal axis and a second lineal member having a second longitudinal axis, a universal key operatively configured to connect first lineal member and the second lineal member where the first longitudinal axis and the second longitudinal axis may form an angle other than ninety degrees.

In another embodiment a fenestration trim assembly includes at least a first lineal and a sill. A connector operatively couples the first lineal to the sill and includes a first member operatively received within a hollow interior of the sill. The connector includes a cover operatively covering an opened end of the sill. A second separate member is positioned adjacent the exterior portion of the sill and is operatively received within the lineal, wherein the profile of the lineal is different from the profile of the sill 1.

In another embodiment a fenestration trim assembly includes a trim assembly member forming a frame including at least one lineal member and a sill member. A first connector operatively couples the lineal member to the sill member. The first connector includes a first leg operatively received within a hollow interior of the sill; and a cover operatively covering an opened end of the sill. A second connector separate from the first connector and offset from a terminal end of the sill that is covered by the cover. The second connector has an extension operatively received within a hollow interior of the lineal member, wherein the second connector can be positioned at a plurality of locations from the terminal end of the sill.

In another embodiment a stucco key includes a body having a first leg configured to be operatively coupled to a feature of a fenestration frame in a first orientation. The stucco key includes a second leg offset from the first leg and configured to be operatively coupled to the feature of the fenestration frame in a second orientation. A lip extending from the stucco key body is at a first distance from the first leg and a second distance from the second leg.

In another embodiment a fenestration assembly includes a window assembly including a frame and a stucco key having a body with a stucco lip extending there from and a connector selectively coupling the body to the frame in a first orientation and a different second orientation, the stucco lip being a first distance from the frame in the first orientation and a second different distance from the frame in the second orientation.

BRIEF DESCRIPTION OF THE DRAWINGS

FIG. 23 is a partial exploded view of three lineal members and two corner keys of FIG. 21.

FIG. 24 is a partial isometric view of the three lineals secured together with the corner keys of FIG. 23.

FIG. 33 is a partial exploded view of two lineal members, a sill and three connectors of FIG. 31.

FIG. 34 is a partial isometric view of two lineals and a sill secured together with the connectors of FIG. 33.

FIG. 52 is an isometric view of the end cap and connector of FIG. 33.

FIG. 53 is a cross-sectional view of the end cap and connector of FIG. 52 securing two lineals.

FIG. 54 is a cross sectional view of a trim portion secured to a frame with a clip.

FIG. 67 is a partial cross sectional view of two lineals secured at a 90 degree angle.

FIG. 68 is a partial cross sectional view of two lineals secured at 180 degrees, such that the longitudinal axis of the first lineal is co-linear with the longitudinal axis of the second lineal.

FIG. 69 is a cross sectional view of two lineals secured together at 180 degrees with the universal corner key.

DETAILED DESCRIPTION

Figure 1:
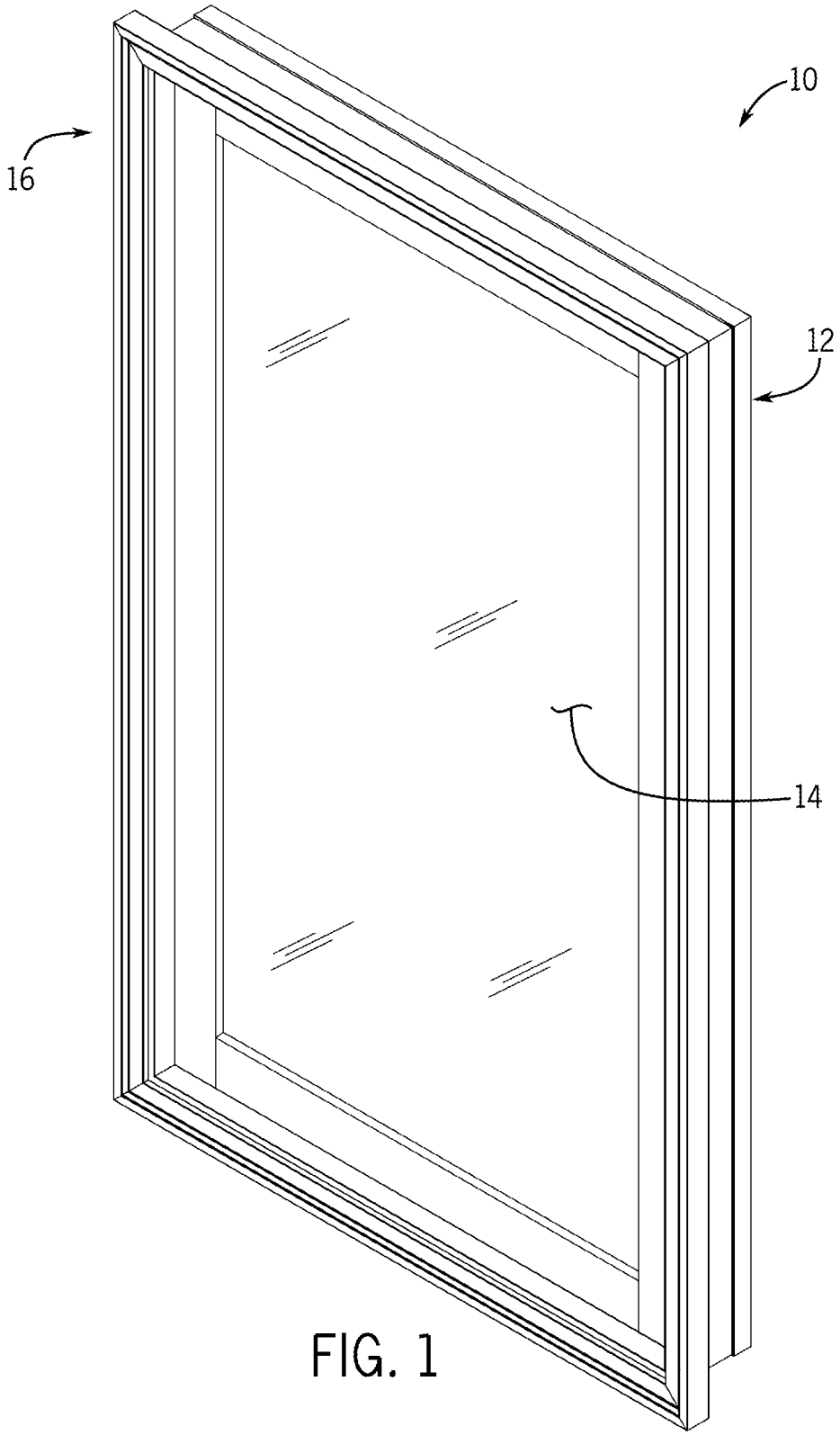
FIG. 1 is an isomeric view of a fenestration trim assembly secured to a frame.

Referring to FIG. 1 a fenestration assembly 10 includes a frame 12 for an architectural element such as a door or window 14 in an opening for an architectural structure such as building. In one embodiment frame will be for a window 14, however frame 12 may be employed or a door or other type of fenestration structure. Window 14 may be a picture window, a double hung or single hung window or other type of windows known in the art. A trim assembly 16 forms a trim frame that includes a number lineals that form a structure that is positioned about fenestration frame 12.

A number of trim attachment components, systems and methods are disclosed in the various figures discussed herein. The components, systems and methods may be used either alone or in various combinations. It is contemplated that depending on the complexity of the window, door or other structure about which trim is to be applied the components and methods may be used in any combination.

To provide an orientation for discussion, the term outwardly direction will refer to the direction that faces away from the building structure that supports the fenestration assembly in a vector direction from the inside of the building structure toward the outside of the building structure. If a user is standing outside of a building and looking at the fenestration trim assembly, the user would see the outwardly surfaces of the fenestration trim assembly. Similarly, if a person is standing inside of a building structure and looking at the fenestration trim assembly the user would see the inwardly surfaces of the fenestration trim assembly. In one embodiment trim assembly 16 is secured to the outwardly surface of frame 12. In the examples provided herein the fenestration trim assembly will be secured to the fenestration frame on the outside of the building structure or in the outwardly direction from the fenestration frame.

However it is also contemplated that the a decorative trim assembly may be secured to a fenestration frame to decorate the portion of the frame that faces into the building structure such as in to a room of a building. In this orientation the trim assembly would be secured to the inwardly facing surface of the fenestration frame. When a trim assembly is being secured to a fenestration frame that faces into a room of a building structure, the terms inwardly and outwardly as used herein are understood to be reversed as discussed above.

Figure 2:
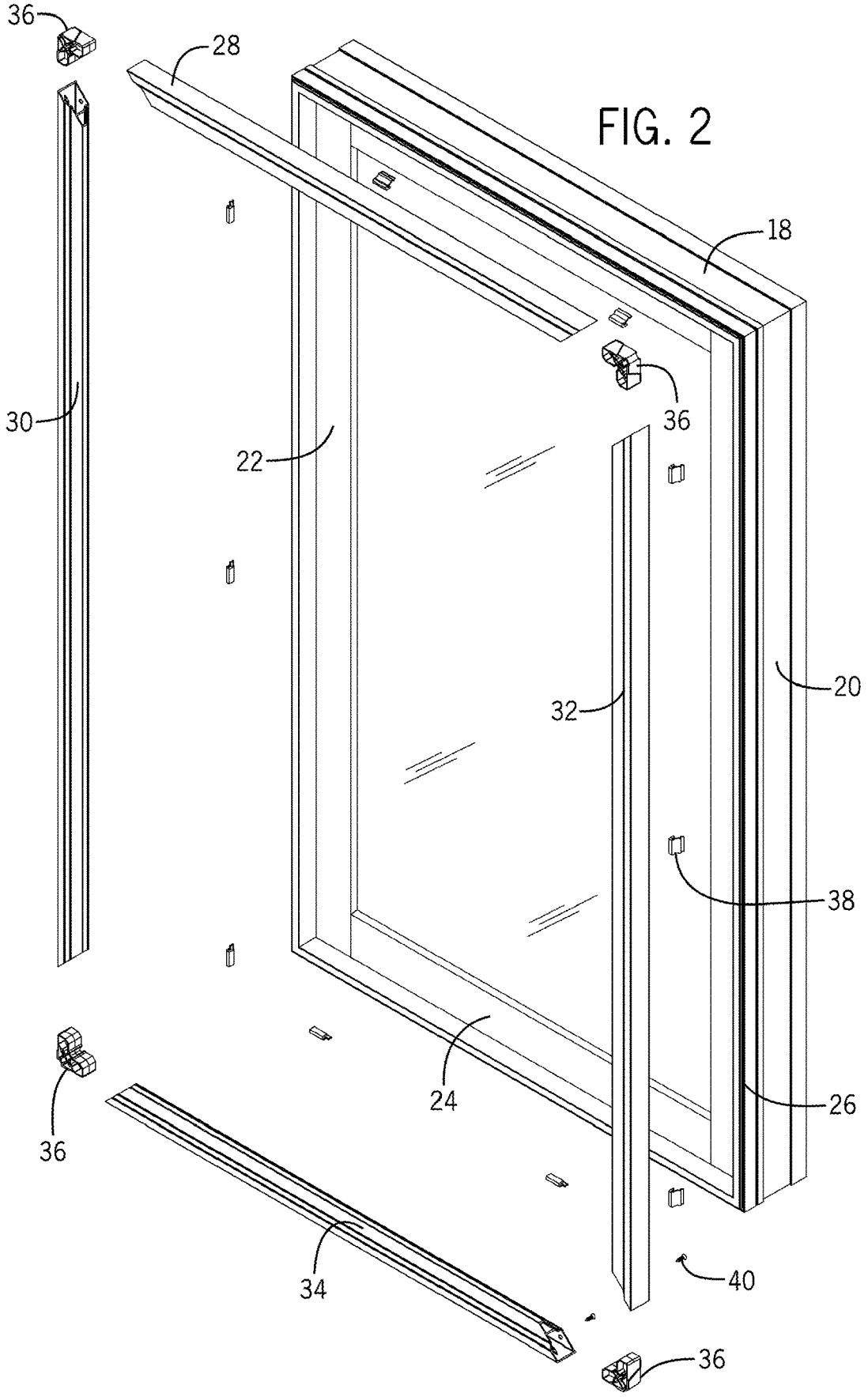
FIG. 2 is an exploded view of the fenestration trim assembly of FIG. 1.

Referring to FIG. 2 one embodiment of a first fenestration trim assembly 10 includes a fenestration frame 12 includes a header 18, vertical jambs 20 and a sill. A sash located within frame 12 may include two parallel and spaced stiles 22 and two parallel spaced rails 24. In one embodiment trim assembly 16 includes a trim header 28, a first vertical member 30 and a second parallel and spaced vertical member 32 and a trim sill 34. The term lineal as used herein refers to in general each of trim header 18, vertical members 30, 32 and sill 34. A lineal may be a straight elongated member or the lineal may have an arcuate or other shape.

In one embodiment each of header 18, vertical members 20, and sill 24 are like lineal members having a hollow interior and the same profile. In one embodiment the four lineal members form a rectangular trim frame. Each terminal end of the lineal members are mitered so that adjacent lineal members include a 45 degree terminal portion that provides for the longitudinal axis of adjacent lineal members to be ninety degrees to one another. In one embodiment having four lineal members, four corner keys 36 connect each respective adjacent lineal members.

Figure 3:
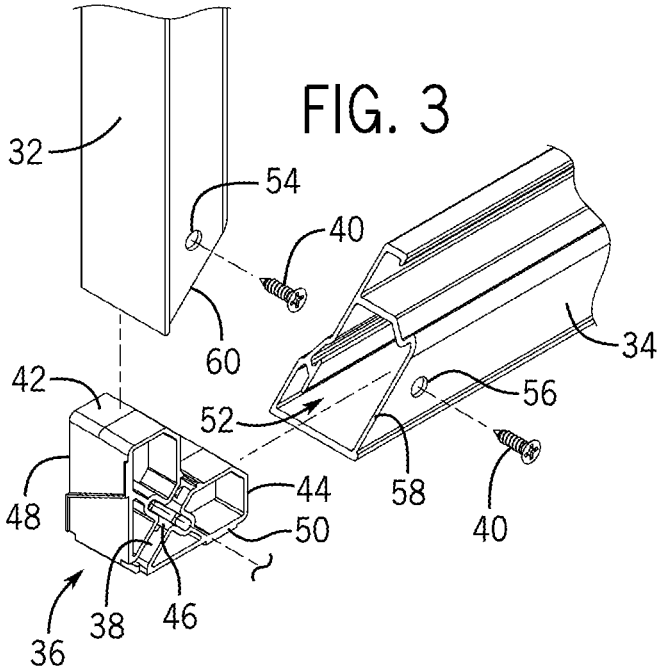
FIG. 3 is a partial exploded view of two lineal members and a corner key of FIG. 1.
Figure 44:
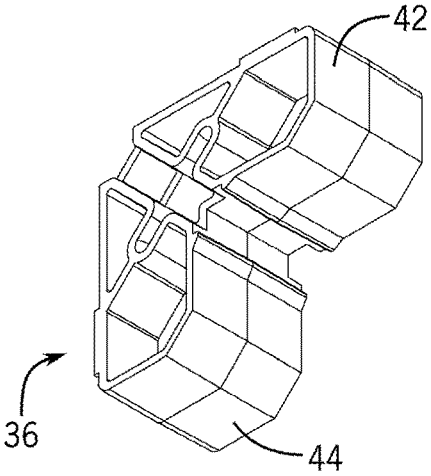
FIG. 44 is an isometric view of a corner key of FIG. 3.
Figure 45:
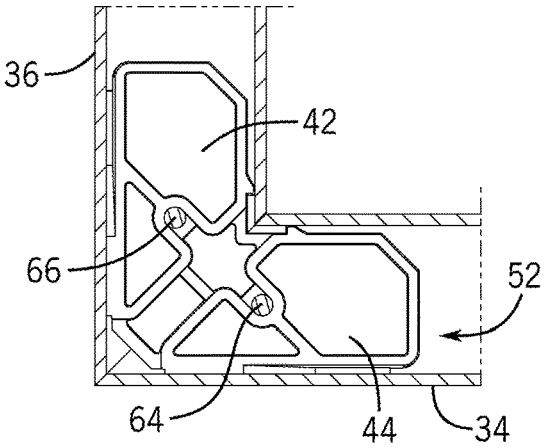
FIG. 45 is a cross sectional view of the corner key of FIG. 44 in two lineal members being secured perpendicular to one another.

Referring to FIG. 3, corner key 36 includes a center portion 38 having a fastener receiving region 46. A first leg 42 and a second leg 44 extend from the center portion 38 at generally right angels to one another. Corner key 36 includes a first outwardly facing side 48 and an inwardly facing side 50. First leg 42 is received within the hollow interior of lineal member 32 and second leg 44 is received within the hollow interior of lineal member 34. Referring to FIG. 44 and FIG. 45 corner key 36 includes a first aperture 66 and a second aperture 64 within fastener receiving region 46. In one embodiment, a first fastener 40 extends through an aperture 54 of lineal member 32 into a first aperture 66 and a second fastener 40 extends through an aperture 58 of lineal member 34 into second aperture 64.

Figure 61:
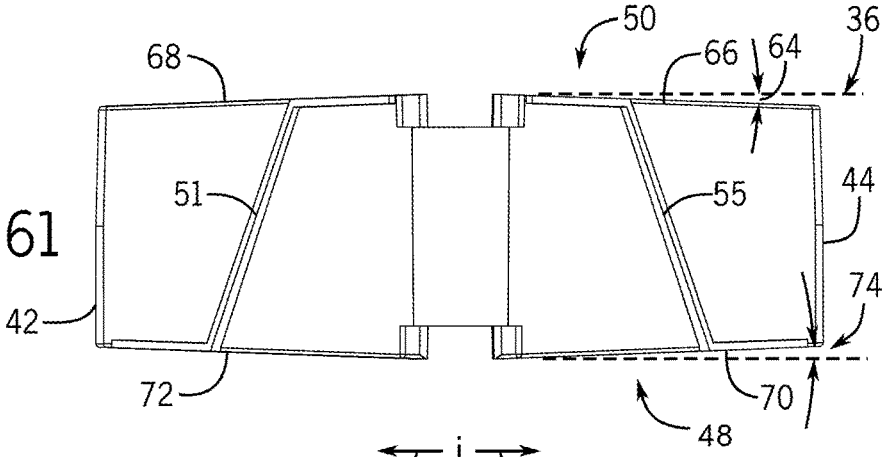
FIG. 61 is a side view of a first corner key.
Figure 62:
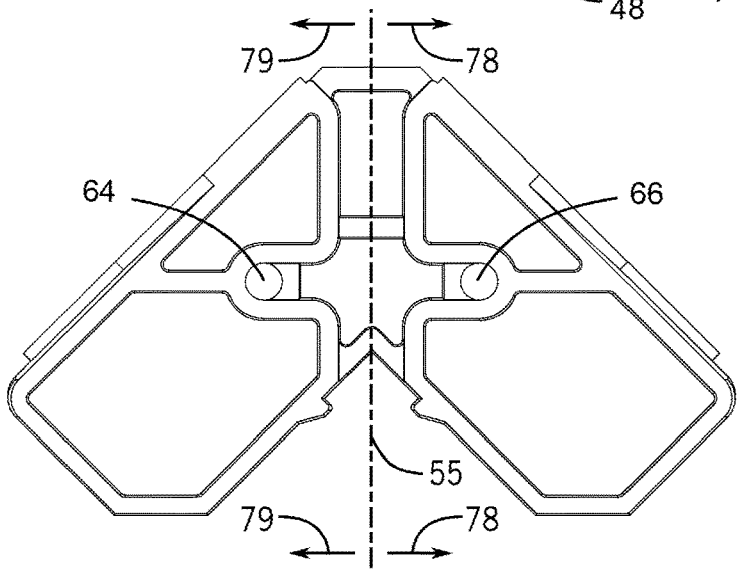
FIG. 62 is a top view of the corner key of FIG. 61.

In one embodiment the distance between the center of aperture 66 and the center of second aperture 64 is less than the distance between the center of aperture 54 and the center of aperture 58. This difference in distance has the effect of drawing the mating edge 60 of lineal member 32 and mating edge 58 of lineal member 34 toward one another as fasteners 40 are tightened. In one embodiment the fasteners enter apertures 54 and 56 of lineal members 32 and 34 respectively from the inwardly facing surfaces of the lineal members. While the mating surfaces 60 and 58 are drawn toward one another Referring to FIG. 61 and FIG. 62, side 50 may include a first sloped surface 70 extending in a perpendicular direction 78 from center line 55 such that surface 70 forms an angle 74 with respect to the perpendicular line 78. Similarly, surface 72 may also slope from center line 55 in a direction 79 that is perpendicular to center line 55 and opposite direction 78. As with sloped surface 70, sloped surface 72 may form an angle equal to angle 74 with respect to the perpendicular line 79.

As will be described in further detail below, the sloped surfaces 70 and 72 provide a torque to lineals 32 and 34 that force the mating edges of the outwardly surfaces of lineal 32 and 34 together as the fasteners 40 secured the lineal 32 and 34 to corner key 36. As fasteners 40 are tightened the interior surface of lineal 34 and the interior surface of lineal 32 adjacent surfaces 70 and 72 are drawn toward surfaces 70 and 72. This drawing of the lineal surfaces toward the sloped surfaces of 70 and 72 acts to pivot lineal 32 and 34 such that the outwardly facing abutting surfaces of lineals 32 and 34 are drawn toward each other providing a tight abutment. This features provides a tight fit between the abutting lines of lineal 32 and 34 along the visible outwardly extending surfaces of lineal 32 and 34 and acts to minimize any gap that may form on the mating lines of adjacent lineals. It is noted that the attachment apertures 76 and 77 in FIG. 62 correspond to the attachment apertures 66 and 64 of FIG. 45 and may be considered to be one and the same.

Figure 4:
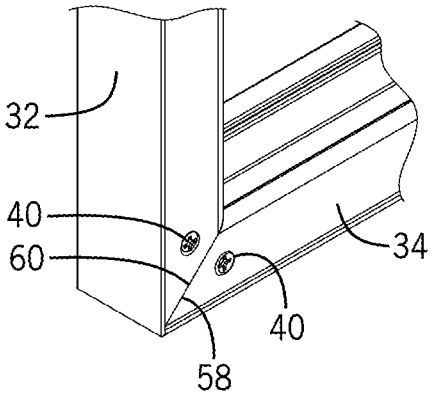
FIG. 4 is a partial isometric view of two lineals secured together with the corner key of FIG. 3.
Figure 5:
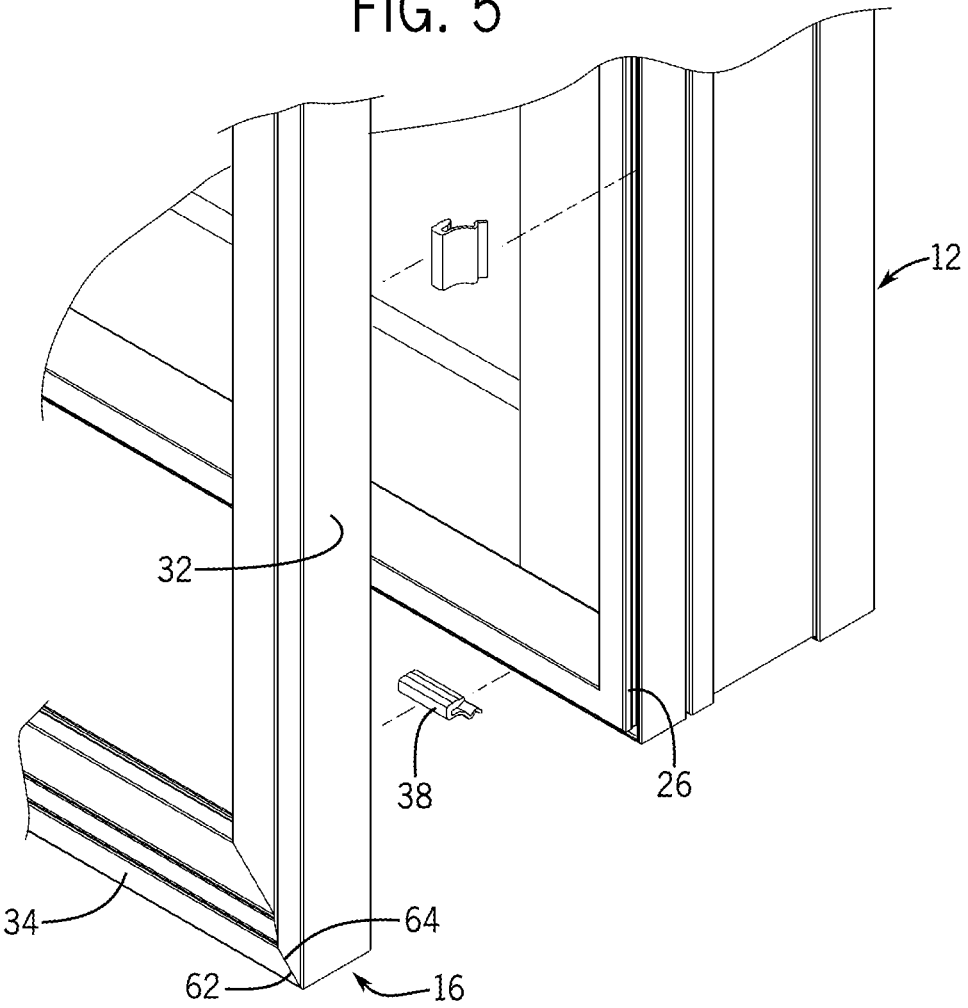
FIG. 5 is a partial exploded view of another embodiment of an assembled trim, clips and fenestration frame.

Referring to FIG. 4 the two lineals secured together with the corner key of FIG. 3. Although FIG. 3 and FIG. 4 illustrate the attachment of end of lineal 32 and one end of lineal 34 with a single corner key 36, it is understood that the remaining corners will be assembled in a like fashion. In one embodiment trim frame 16 includes four lineals, and a total of four corner keys 36 that secure the lineals together to form trim frame 16.

Referring to FIG. 5 and FIGS. 41-43, once trim frame 16 has been created, trim frame 16 may be secured to fenestration frame 12 with a plurality of clips 38. Each clip 38 includes a first portion that is received within an accessory groove and a second portion engages and biases the trim frame 16 toward fenestration frame 12. The manner in which clips 38 operatively engage a trim frame 16 and a fenestration frame 12 is described in U.S. patent application Ser. No. 13/724,222 and entitled Window Trim System which is incorporated herein by reference in its entirety.

Figure 6:
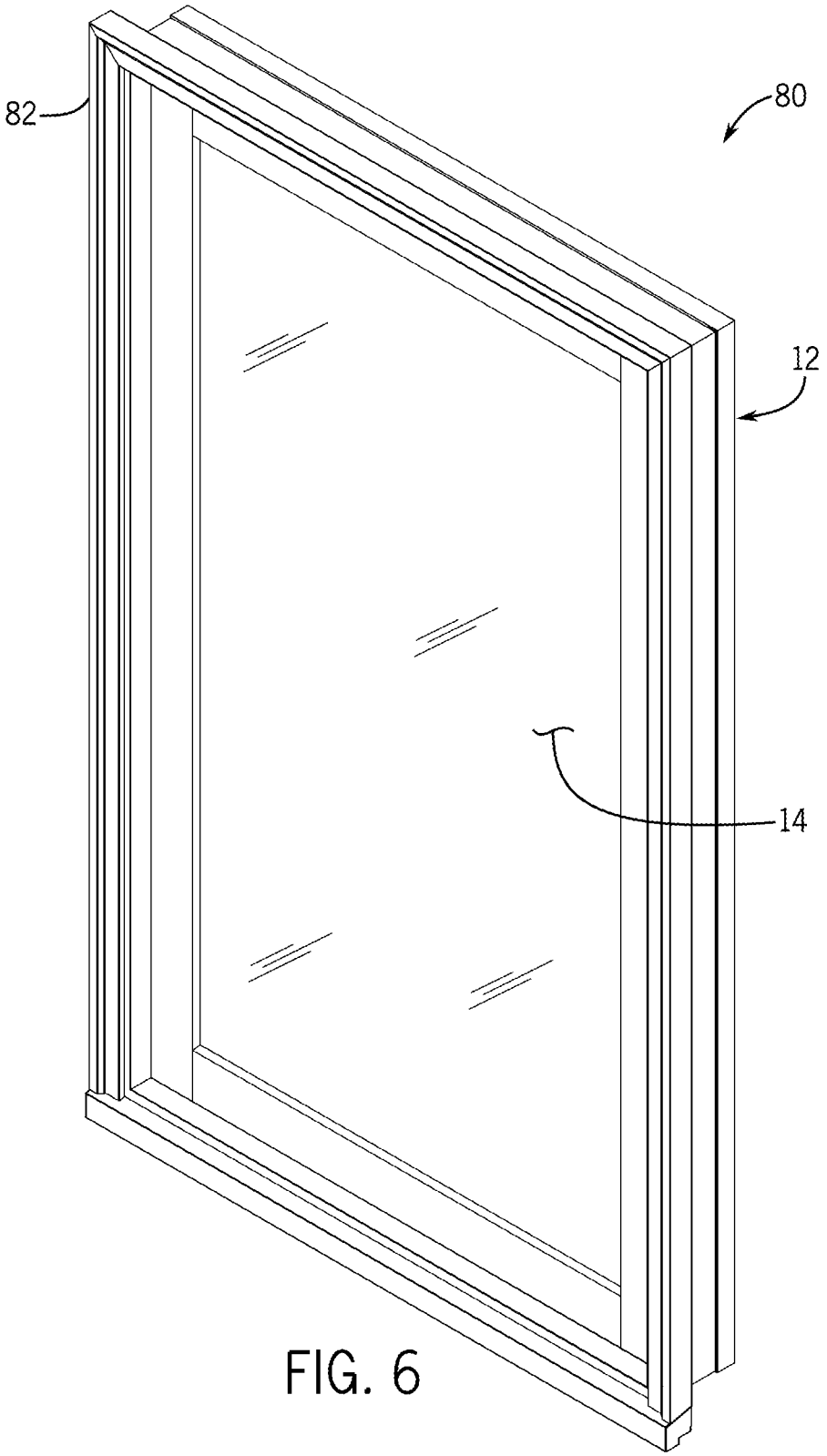
FIG. 6 is an isomeric view of a fenestration trim assembly having a trim assembly with vertical lineals and a sill nose secured to a fenestration frame.
Figure 7:
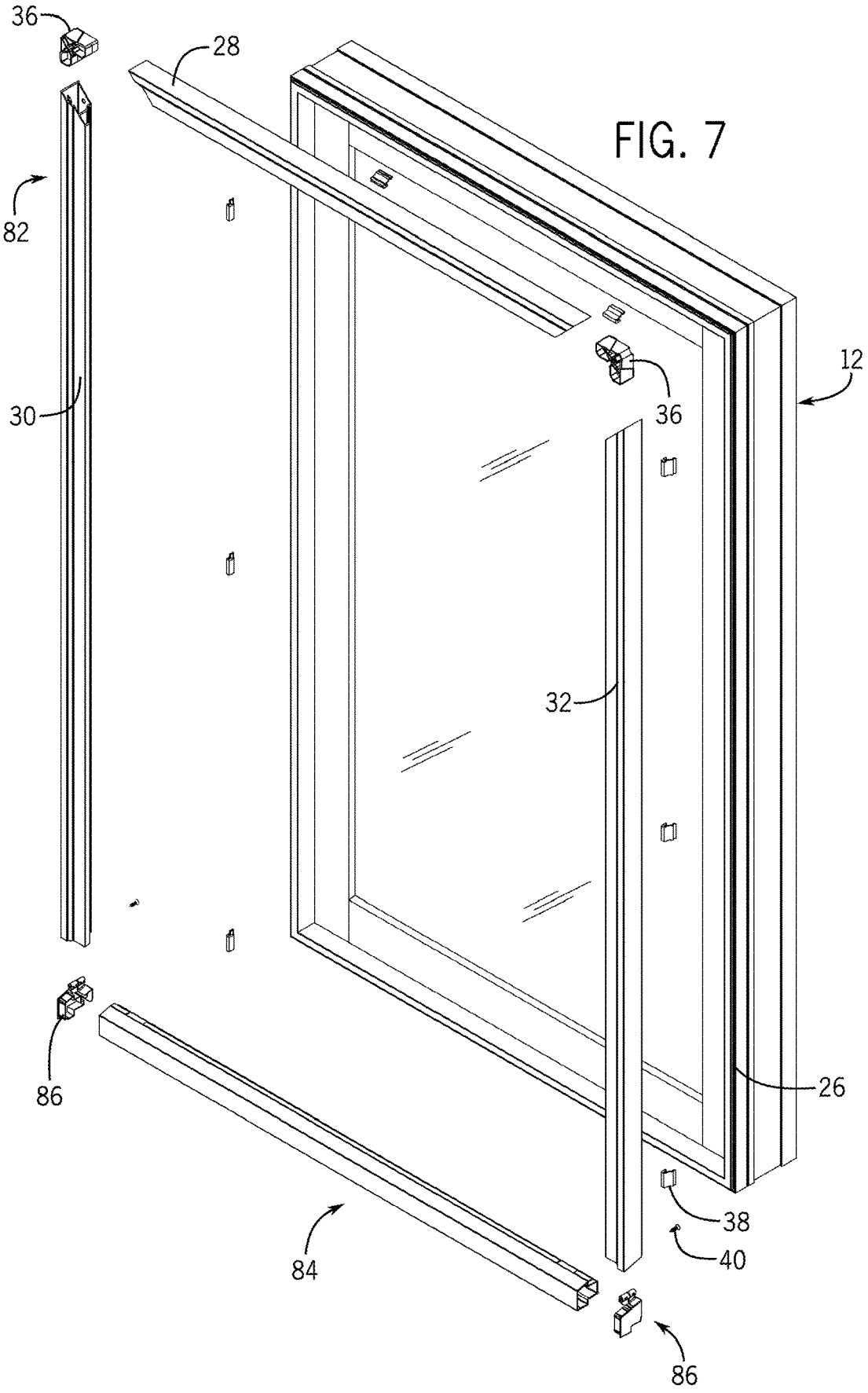
FIG. 7 is an exploded view of the fenestration trim assembly of FIG. 6.

Referring to FIG. 6 another embodiment a fenestration assembly includes a fenestration trim frame 82 that is operatively secured to a fenestration frame 12. Referring to FIG. 7 trim frame 82 includes a header lineal 28, two vertical lineals 30, 32 and a sill 84. The two vertical lineals 30 and 32 are secured to headliner lineal 28 in the manner described above with corner keys 36. In one embodiment vertical lineals 30 and 32 are secured to sill 84 with an end cap connector 86.

Figure 8:
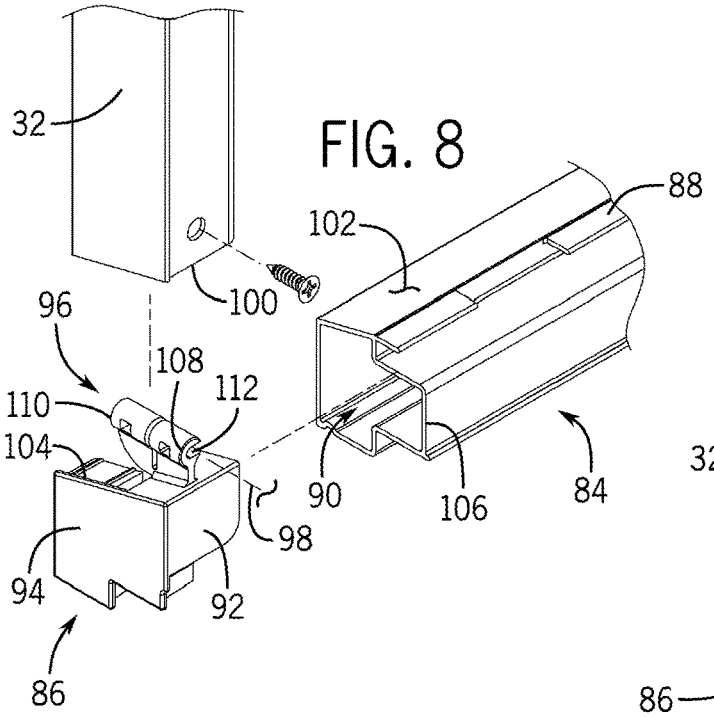
FIG. 8 is a partial exploded view of a lineal, sill nose and a corner key of FIG. 6.

Referring to FIG. 8 end cap connector 86 includes an end cap portion 94, a first extension 92 and a connector 96 extending upwardly from first extension 92. Extension 92 is received within a hollow interior of sill 84. Connector 96 extends upwardly from extension 92 and is received within a hollow interior of lineal 32. Connector 96 includes an elongate body 108 having an inwardly receiving end 112 and an opposing outwardly end 110. Sill 84 includes a top surface 102 and an inwardly extending flange 88.

Figure 46:
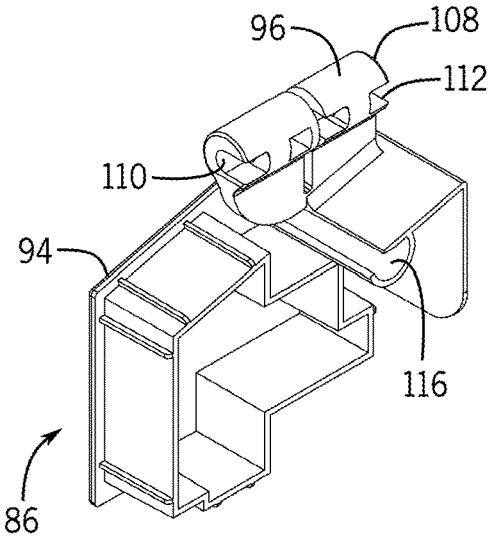
FIG. 46 is n end cap and connector of FIG. 33.
Figure 47:
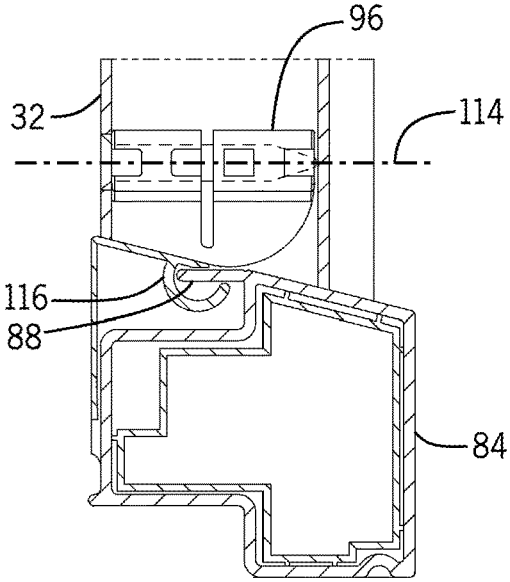
FIG. 47 is a cross-sectional view of the end cap and connector of FIG. 46 securing a sill and lineal.

Referring to FIG. 46 and FIG. 47 end cap connector 86 includes a channel portion 116 that may be received within a portion of flange 88. A fastener such as a screw is inserted through an aperture extending through the inwardly facing surface of lineal 32 and into aperture in elongated body 108 entering through receiving end 112 along an elongated axis 114 of elongated member 108. Once the fastener secures end cap connector 86 to lineal 32 extension 92 may be received within the interior hollow portion of sill 84 such that end cap 94 covers the open end of sill 84. In a similar manner the opposite end of sill 84 may be fastened to second lineal member 30 with a second end cap connector that may be reversed to match the second side of the sill 84.

Figure 9:
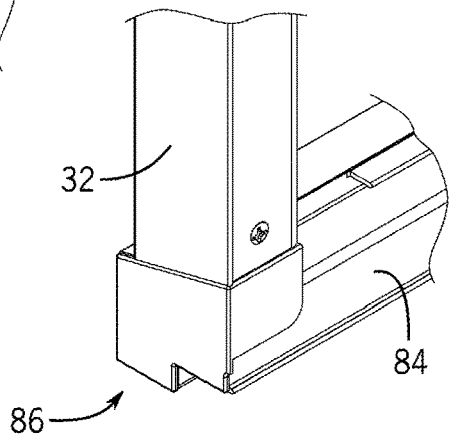
FIG. 9 is a partial isometric view of the assembled vertical lineal, sill nose and corner key of FIG. 8.
Figure 10:
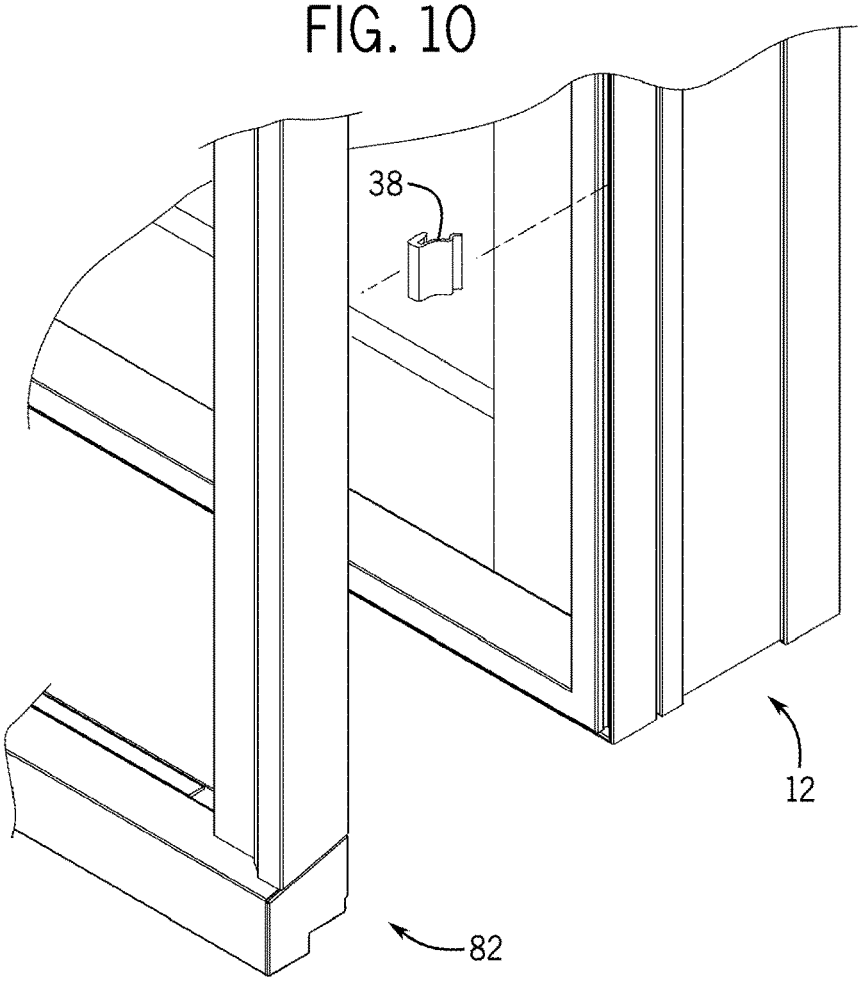
FIG. 10 is a partial exploded view of the assembled lineal, nose sill, clip and fenestration frame of FIG. 6.

Referring to FIG. 9 and FIG. 10 trim frame 82 is completed by securing lineals 30 and 32 to sill 84 and securing the opposing terminal ends of lineals 30 and 32 to header lineal 28. The completed trim frame 82 is secured to fenestration frame 12 with a plurality of clips 38 as discussed above. As will be discussed further below with respect to connector 126, extension member 96 may be supported with a vertically extending member that may have a slope such that lineal 32 is caused to pivot about a line parallel to the longitudinal axis of sill 84 to force the mating edge of lineal 32 on the outwardly fading surface against a top portion 102 of sill 84.

Figure 11:
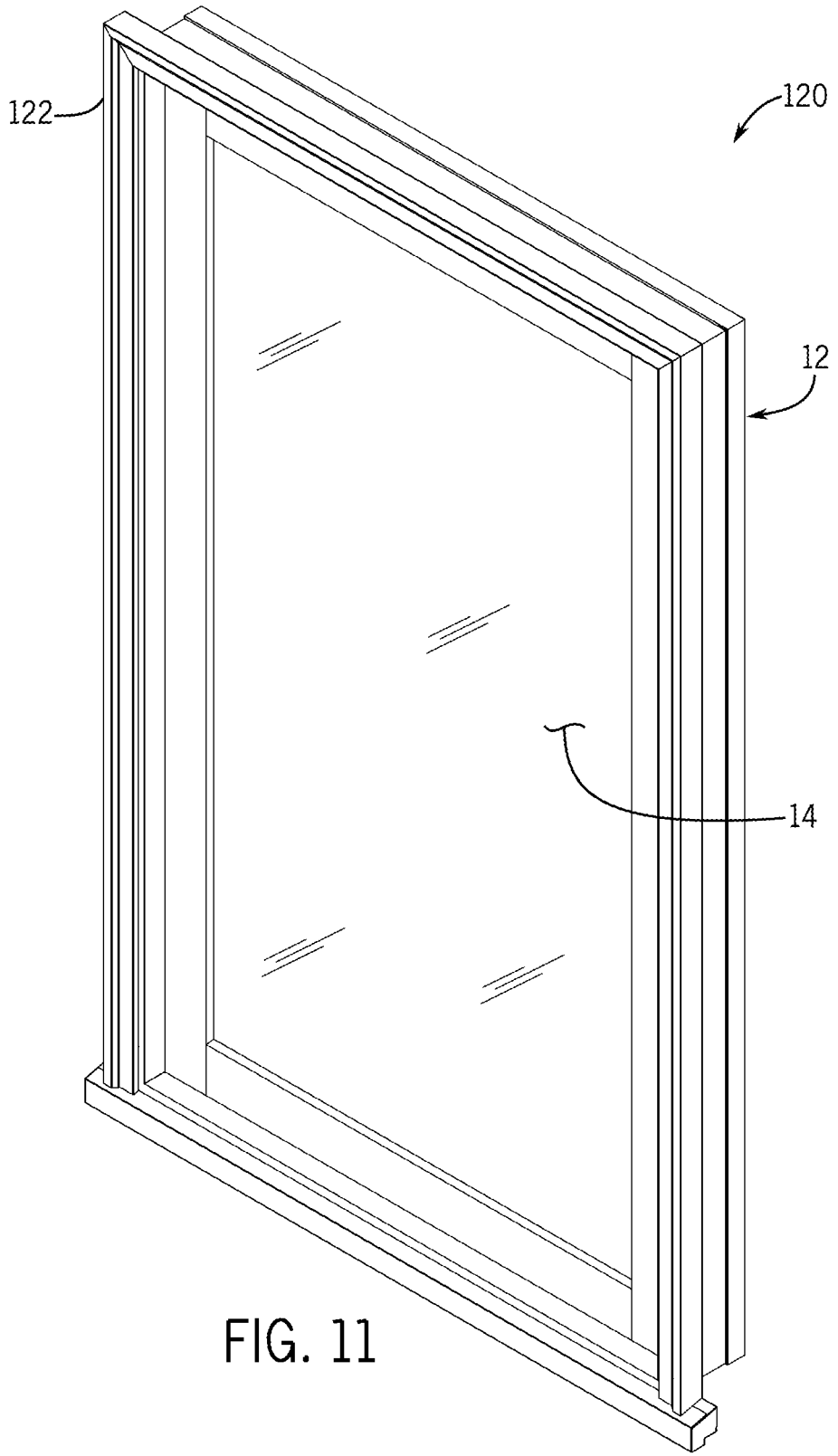
FIG. 11 is an isomeric view of another embodiment of a fenestration trim assembly having a trim assembly with vertical lineals and a sill nose provided with a sill horn secured to a fenestration frame.
Figure 12:
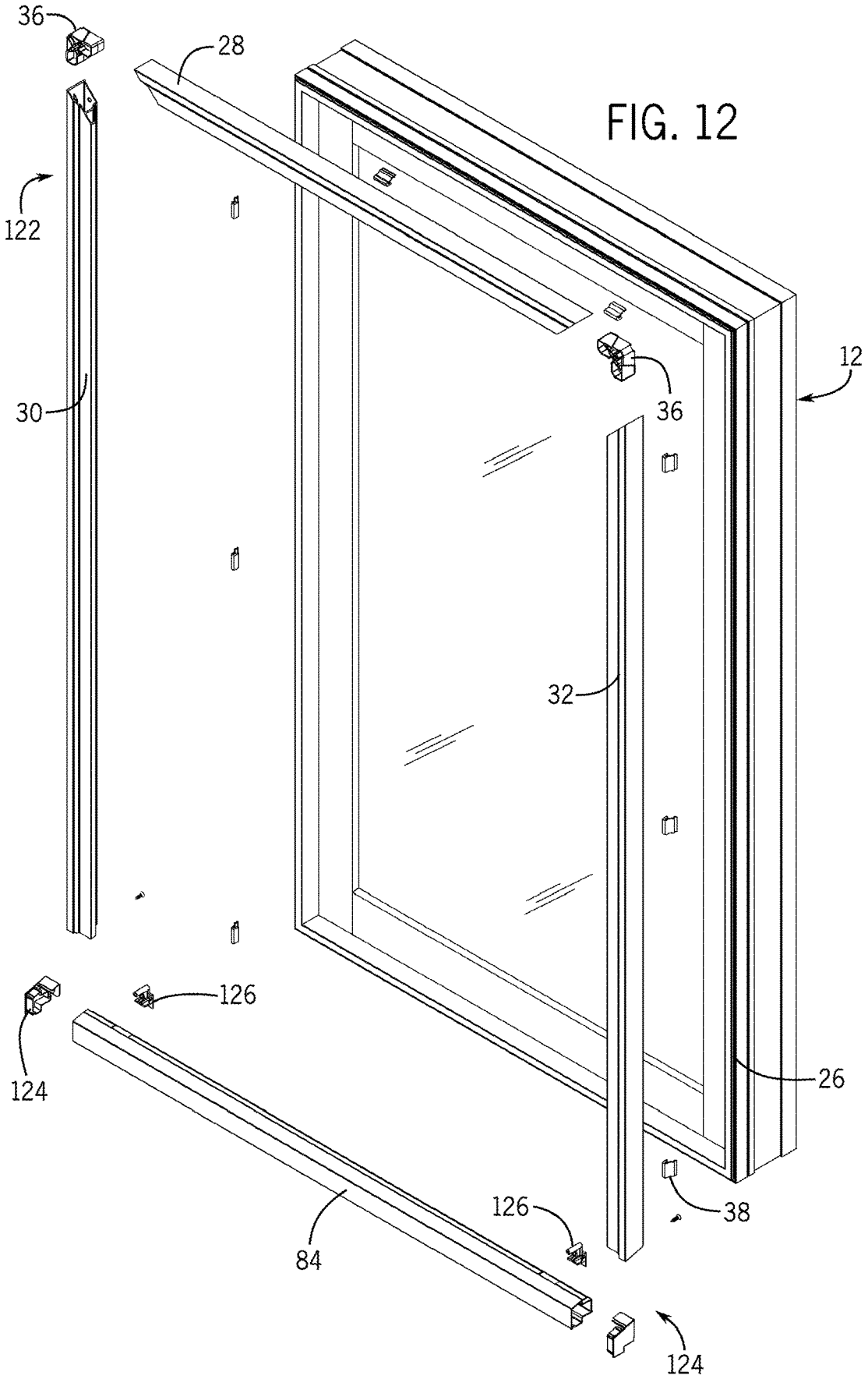
FIG. 12 is an exploded view of the fenestration trim assembly of FIG. 11.

Referring to FIG. 11 and FIG. 12, another embodiment of a fenestration trim frame 122 is operatively secured to fenestration frame 12. Fenestration trim 16 includes a header lineal 28 and two vertical lineal members 30 and 32 along with a sill member 84. The two vertical lineals 30 and 32 are secured to headliner lineal 28 in the manner described above with corner keys 36. Sill 84 however is secured to vertical lineals 30 and 32 with an end cap connector 124 and a separate vertical lineal connector 126. The separate vertical lineal connector 126 permits the creation of a horn 128. As will be discussed below, vertical lineal connector 126 allows the size of the horn to be any distance from the terminal end of the sill 84. In one embodiment the vertical lineal connectors 126 may be positioned at discrete locations from the respective terminals ends of sill 84 while in another embodiment the vertical lineal connectors 126 may be positioned at any distance from the respective terminal end of sill 84 between the terminal ends of sill 84.

Figure 13:
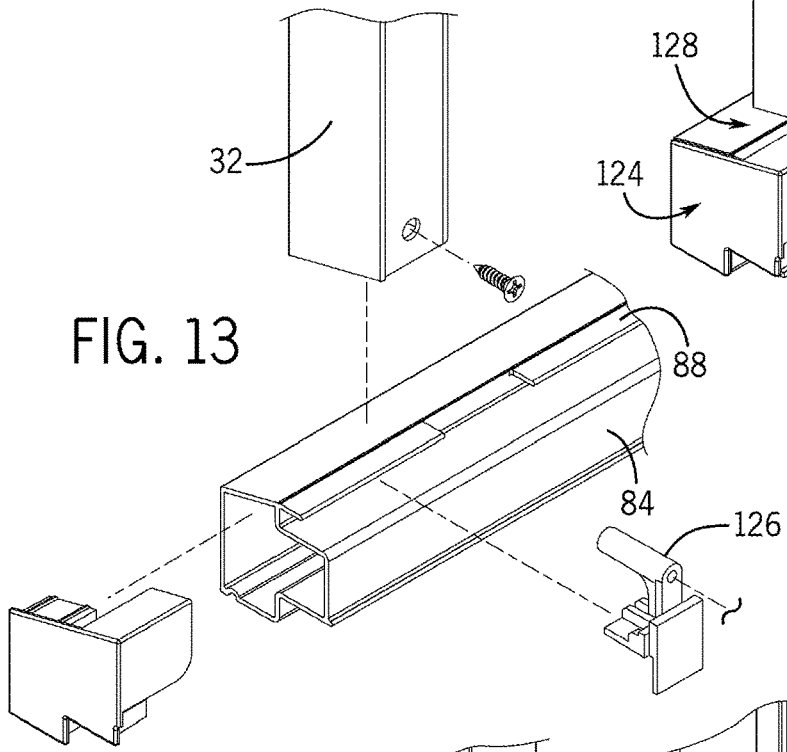
FIG. 13 is a partial exploded view of a lineal, sill nose, end cap and connector of FIG. 11.
Figure 14:
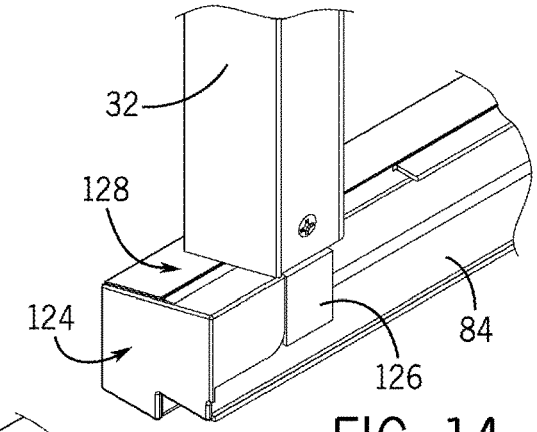
FIG. 14 is a partial isometric view of the assembled vertical lineal, sill nose, end cap and connector of FIG. 13.
Figure 15:
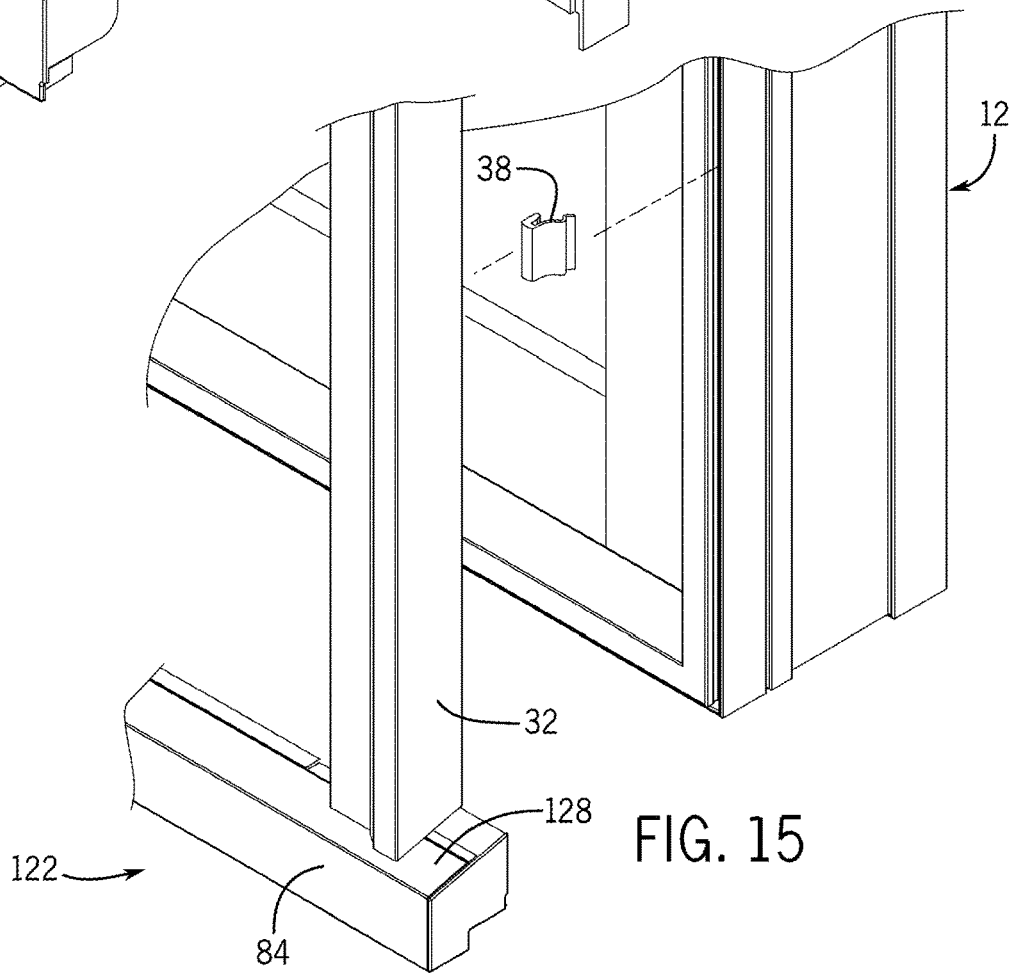
FIG. 15 is a partial exploded view of the assembled lineal, nose sill, end cap, connector, and fenestration frame of FIG. 11.
Figure 16:
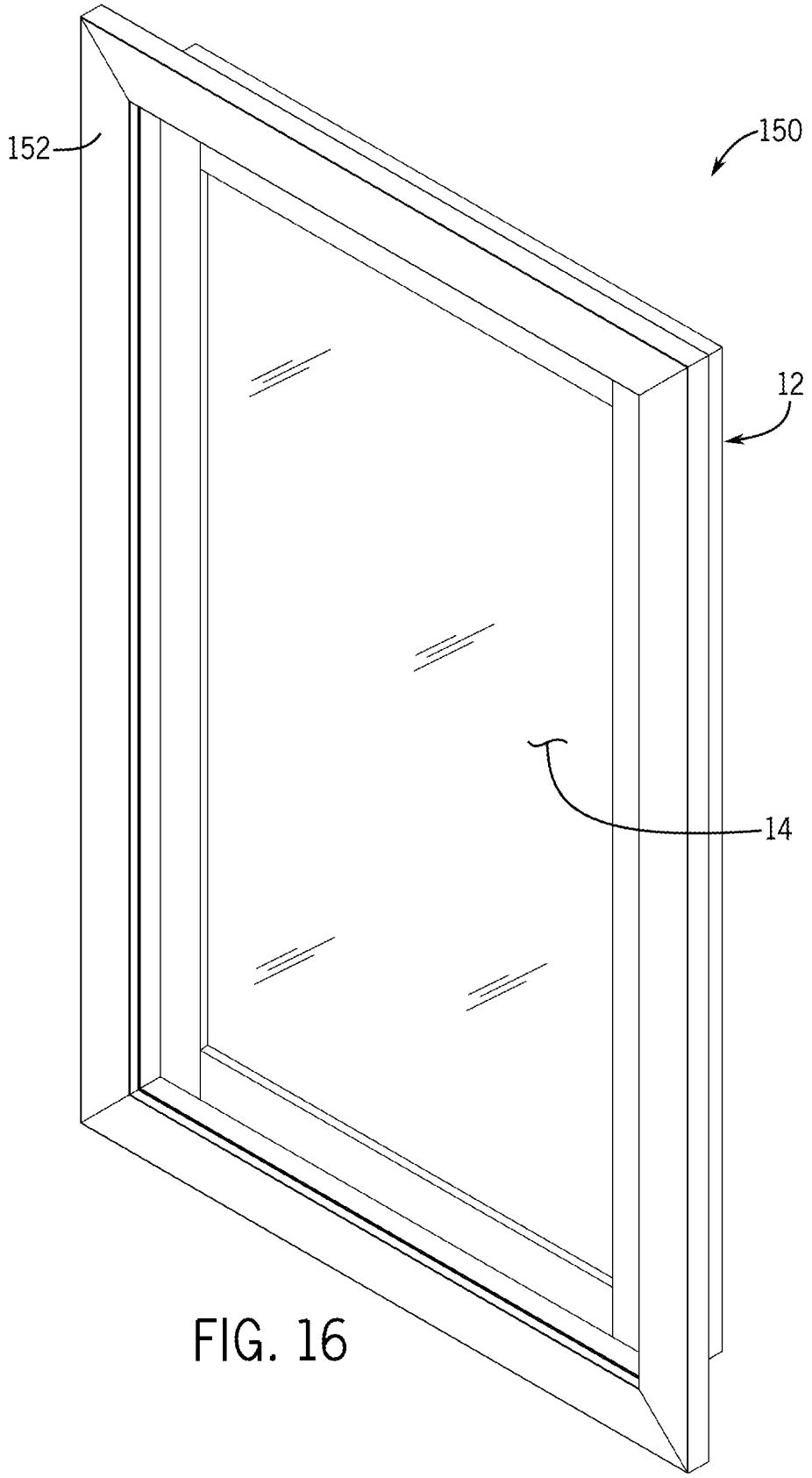
FIG. 16 is an isomeric view of another embodiment of a fenestration trim assembly secured to a fenestration frame.
Figure 17:
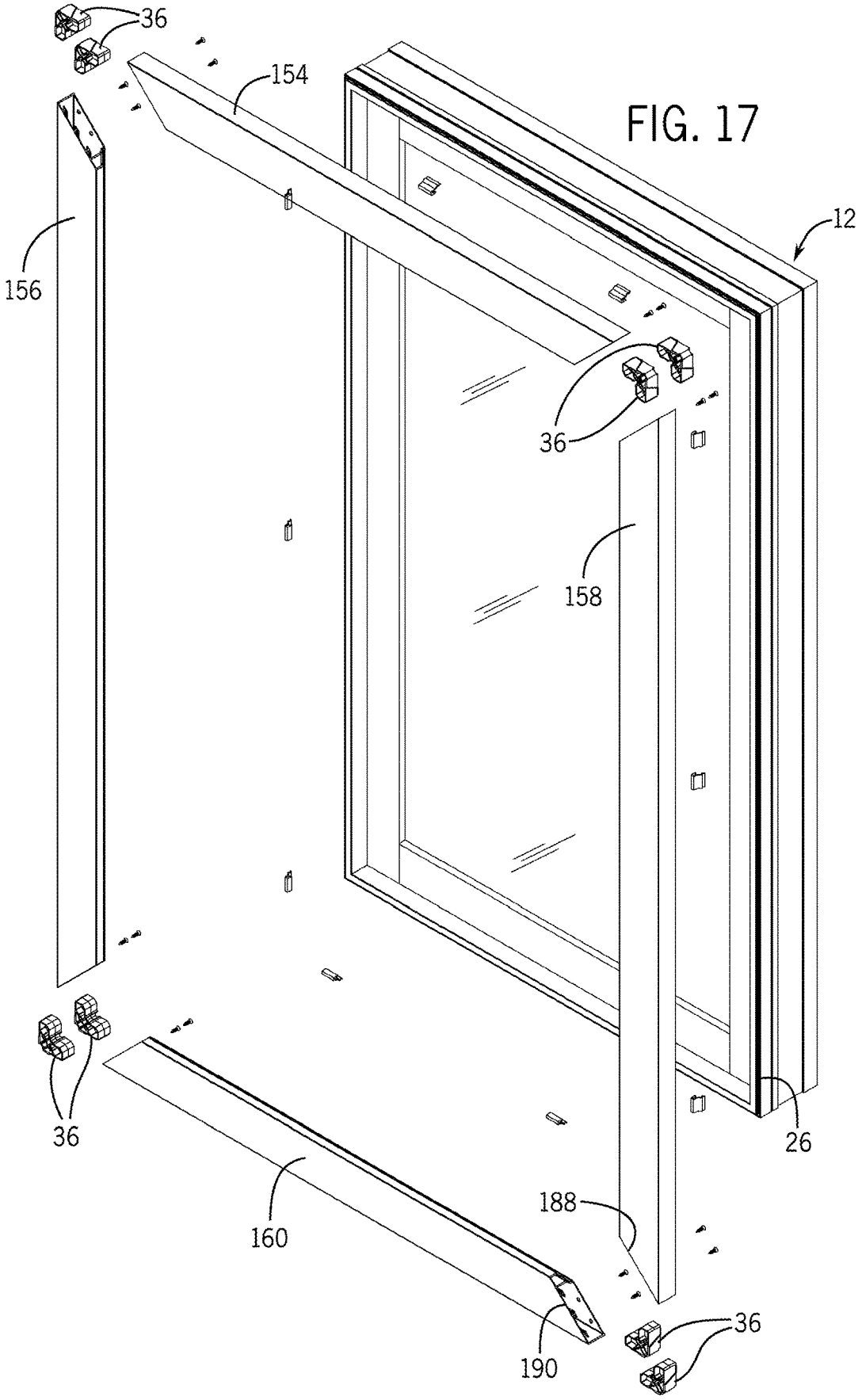
FIG. 17 is an exploded view of the fenestration trim assembly of FIG. 16.
Figure 18:
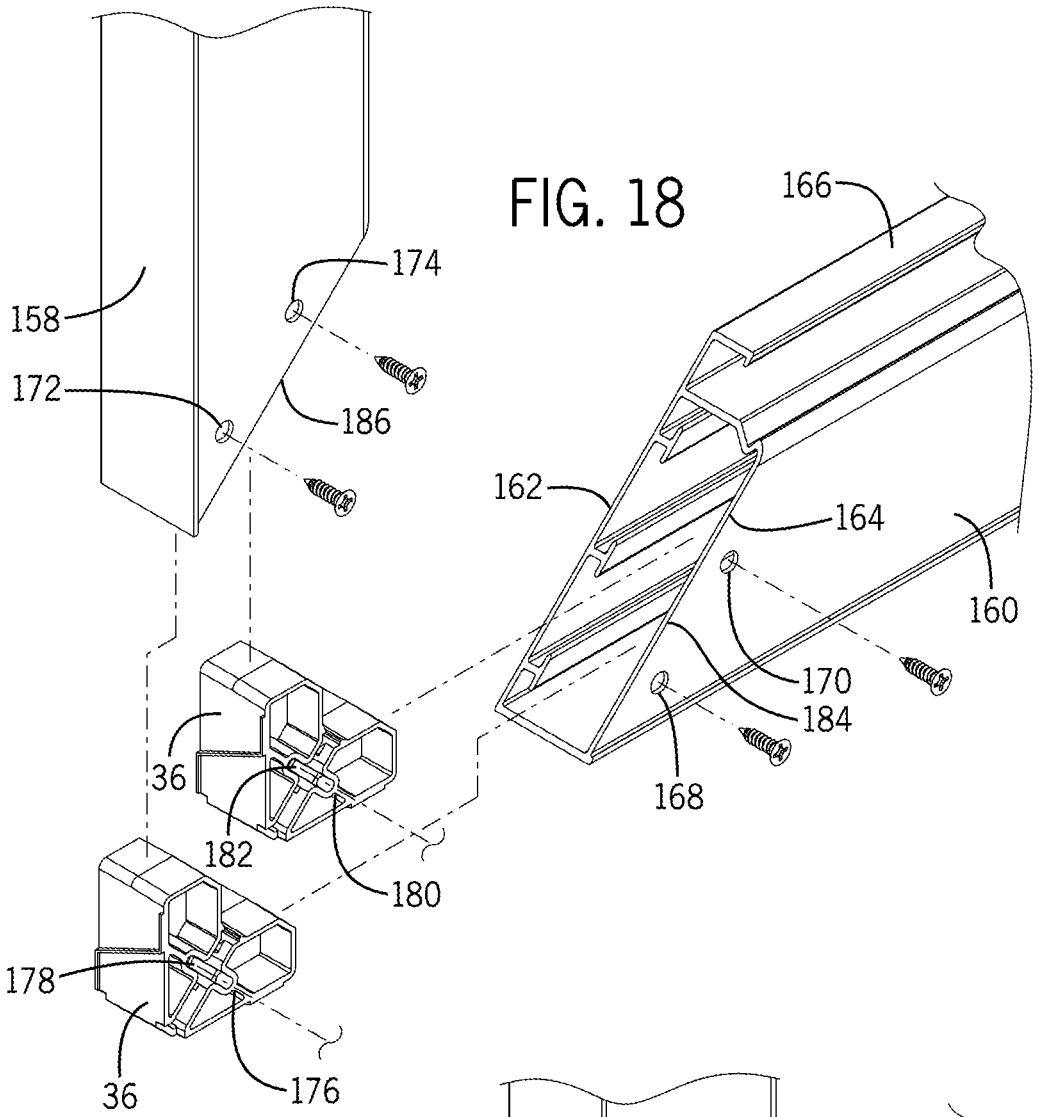
FIG. 18 is a partial exploded view of two lineal members and two corner keys of FIG. 1.
Figure 19:
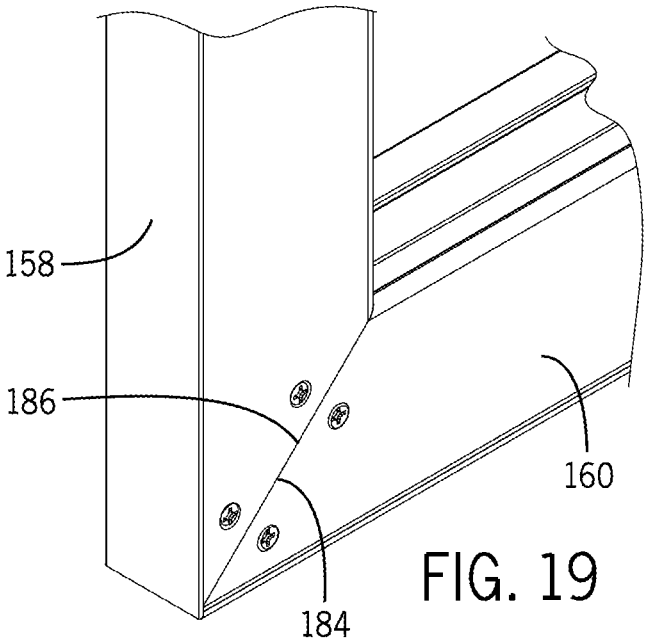
FIG. 19 is a partial isometric view of two lineals secured together with the two corner keys of FIG. 18.
Figure 20:
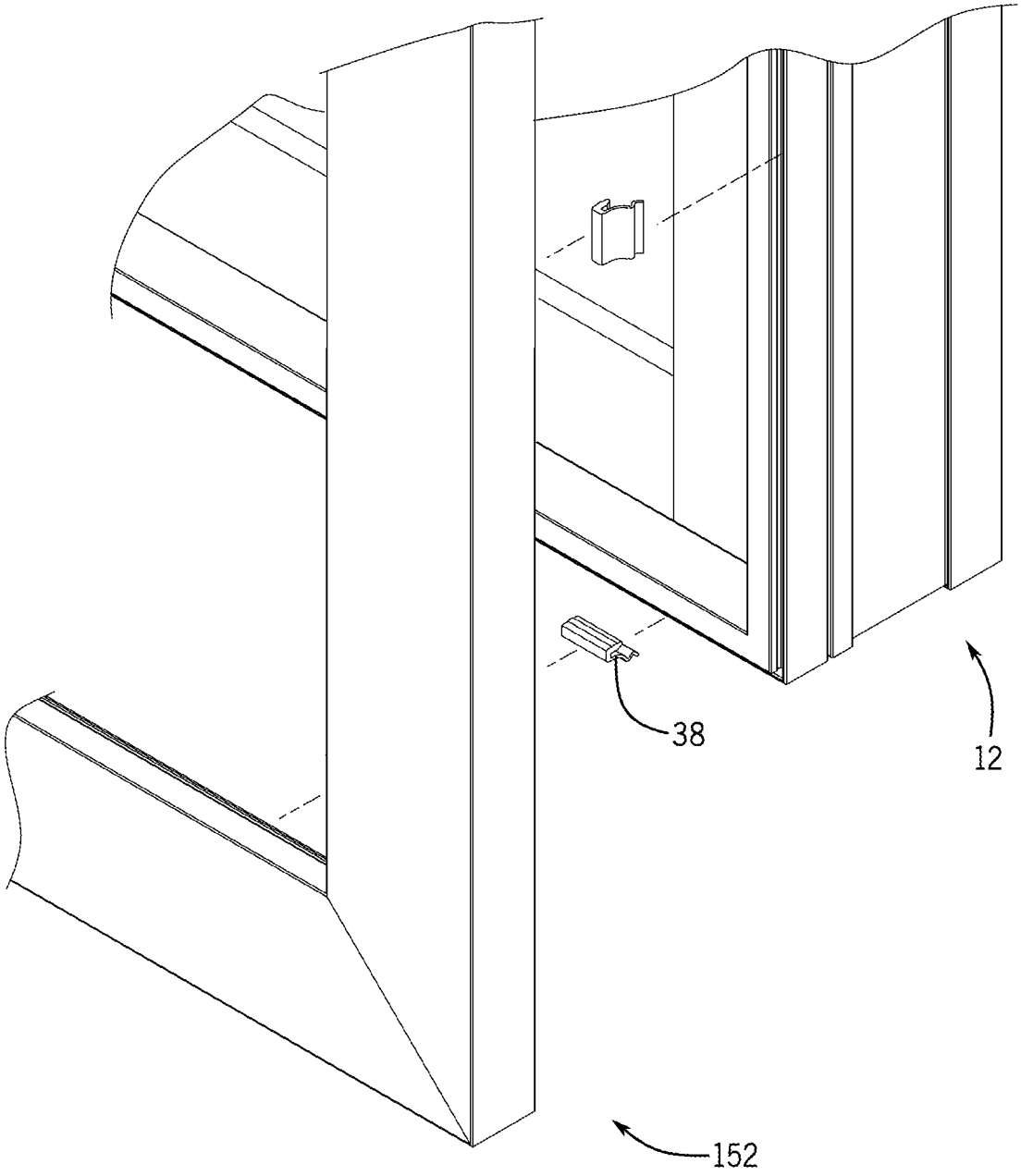
FIG. 20 is a partial exploded view of the assembled trim, clips and fenestration frame of FIG. 16.
Figure 21:
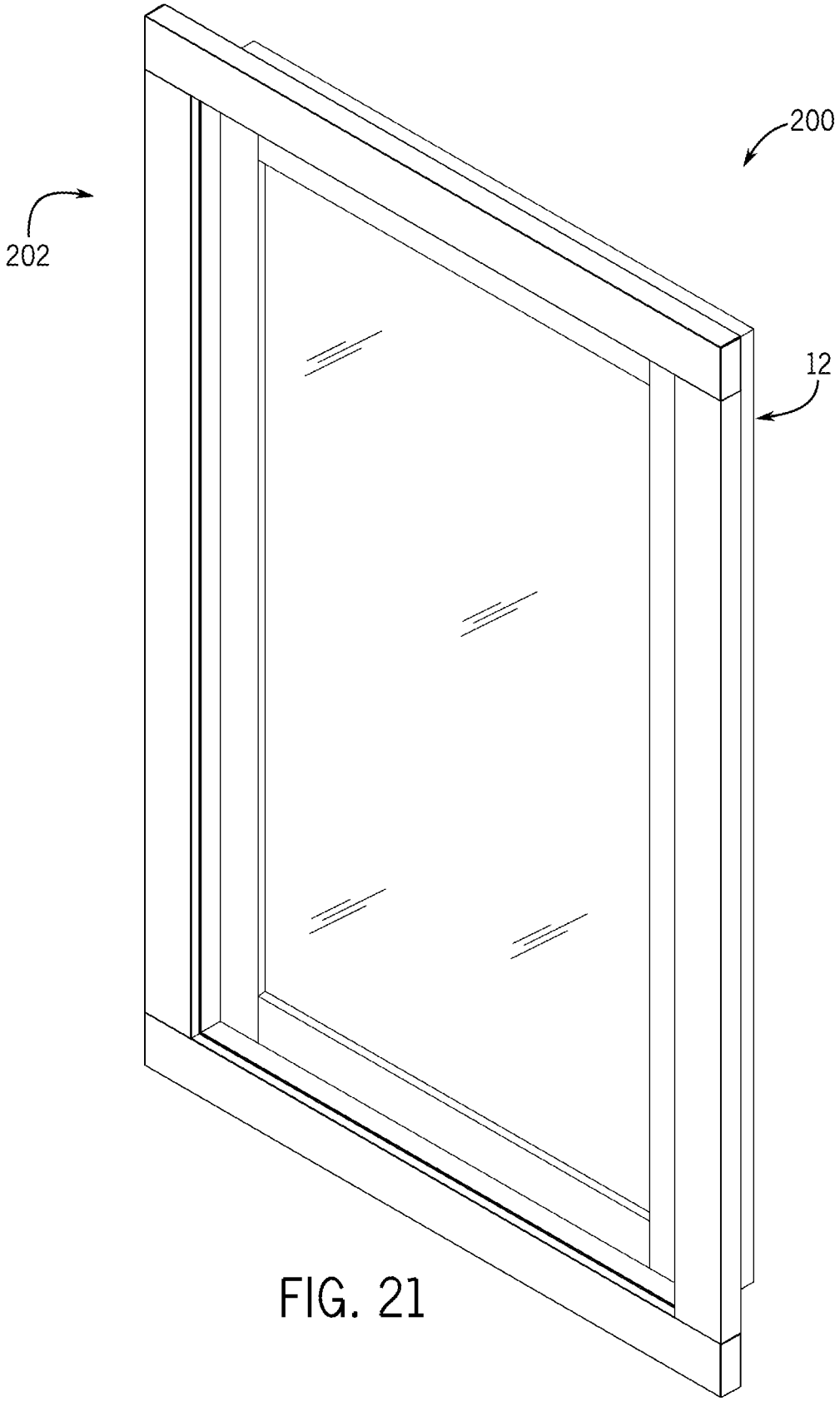
FIG. 21 is an isomeric view of another embodiment of a fenestration trim assembly with butt joints secured to a fenestration frame.
Figure 22:
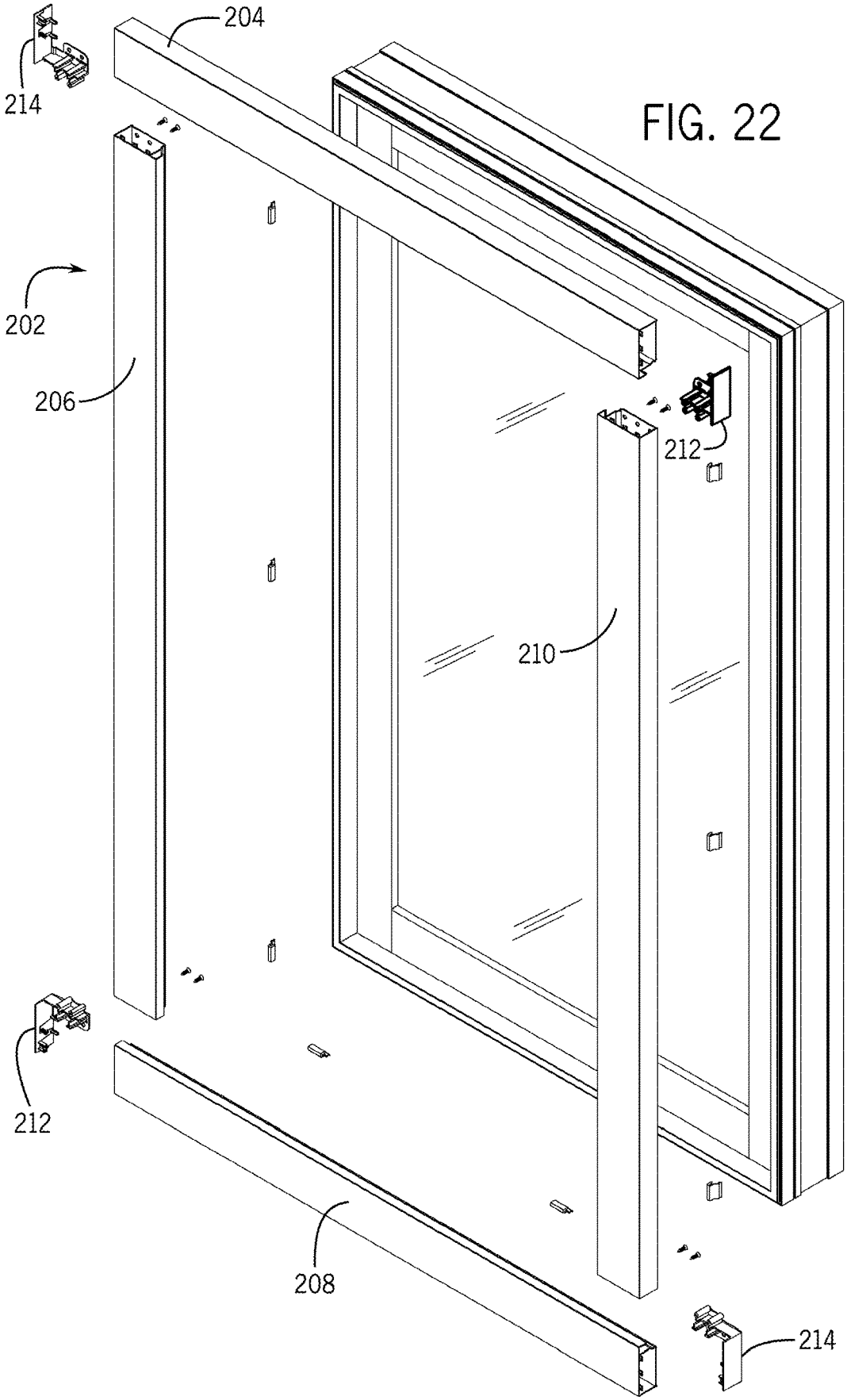
FIG. 22 is an exploded view of the fenestration trim assembly of FIG. 21.
Figure 48:
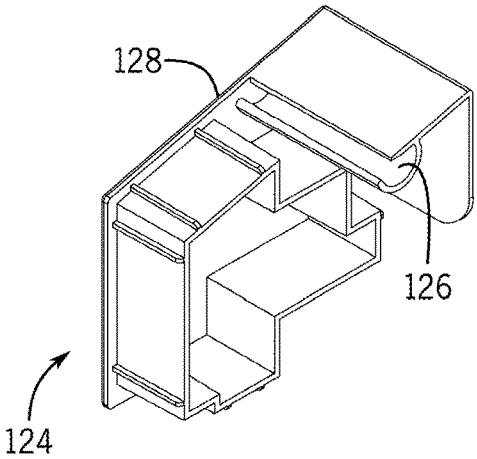
FIG. 48 is an isometric view of the end cap of FIG. 38.
Figure 49:
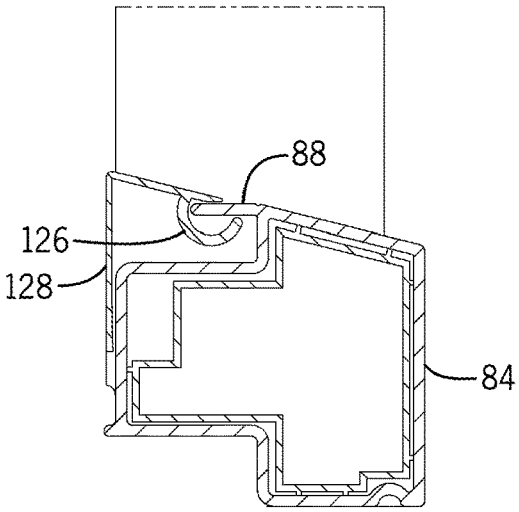
FIG. 49 is a cross-sectional view of the end cap of FIG. 48 secured to a sill.

Referring to FIG. 13 and FIG. 14 end cap connector 124 includes an end cap portion and an extension portion, the extension portion fitting within the interior hollow portion of sill 84 such that the end cap cover the open end of the sill. Referring to FIG. 48 and FIG. 49 end cap connector 124 includes a channel 126 that is operatively Vertical connector 126 is positioned a distance from the terminal end of sill 84 and is operatively connects vertical lineal 32 to sill 84.

Figure 50:
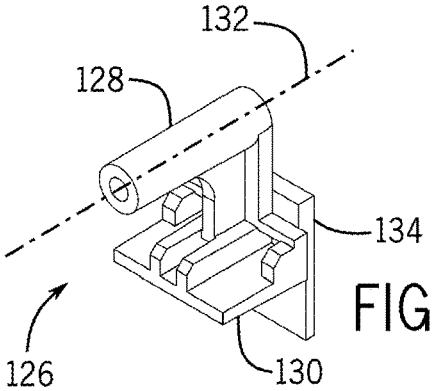
FIG. 50 is an isometric view of a connector of FIG. 38.
Figure 51:
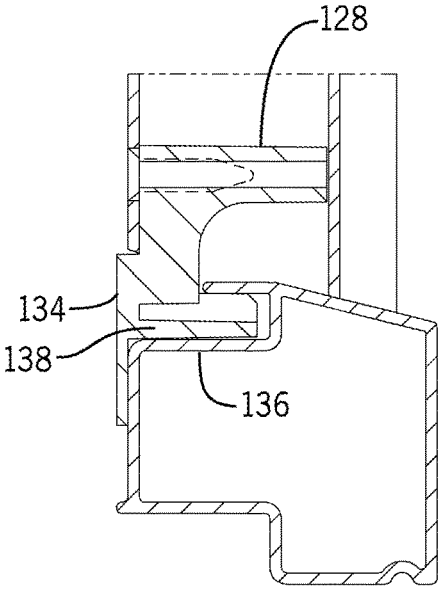
FIG. 51 is a cross sectional view of the connector of FIG. 50 securing a sill and lineal.

Referring to FIG. 50, FIG. 51 connector 126 includes a base portion 130, a back plate 134, and a connector portion 128 having a longitudinal axis 132. Connector portion is supported by a member extending generally upward from base portion 130 generally perpendicular to longitudinal axis 132. the member extending generally upward and the connector portion are positioned within the hollow interior region of lineal 32. Base 130 may rest on a surface 136 of sill 84. In one embodiment connector portion 128 extends upwardly from base 130 in a perpendicular orientation. Connector portion 128 is received within the hollow interior of lineal 32 and extends between an inwardly facing wall and an outwardly facing wall of lineal 32. A fastener extends through an aperture in the inwardly facing wall of lineal 32 and is received within connector 128 along longitudinal axis 132. With base 130 adjacent surface 136 of sill 84 lineal 32 is operatively secured to sill 84. This is in part due to the geometry of the lower edge of outwardly facing surface engaging the sloping portion.

Figure 51A:
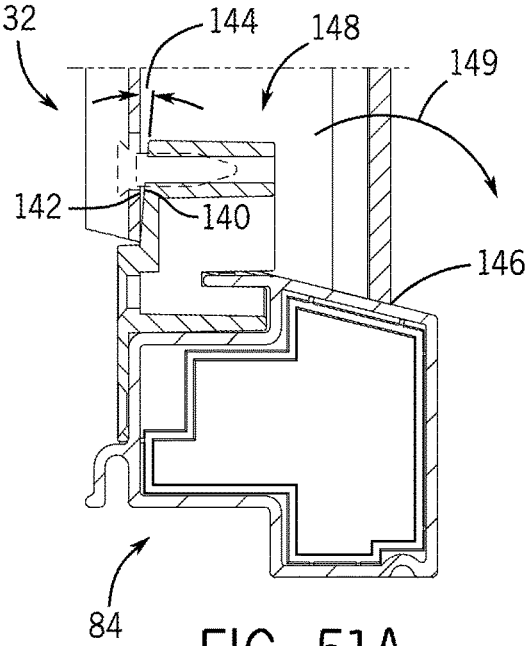
FIG. 51A is a cross sectional view of an alternative embodiment of the connector of FIG. 50 having an angled extension securing a sill and lineal.

Referring to FIG. 51A another embodiment of a connector 148 may be used in conjunction with trim frame 122 to secure sill 84 to lineal 32. Connector portion 128 of connector 148 is supported by an upwardly extending member from base 130. In one embodiment, by design, the inwardly facing wall 140 of the upwardly extending member forms an angle 144 with respect to the outwardly facing surface 142 of the interior hollow region of lineal 32. In one embodiment angle 14 is greater than one degree and in another embodiment the angle is two degrees or greater and yet another embodiment the angel is between two degrees and five degrees. When a fastener extends through the aperture in lineal 32 and into the longitudinal connector of connector 148, lineal 32 is moved toward sloped surface 140 such that lineal 32 is pivoted in the direction 149. Direction 149 in one embodiment is the vector direction about the longitudinal axis of sill 84 or about a vector that is parallel to the longitudinal axis of sill 84. The result is that the terminal portion of outwardly extending face of lineal 132 is forced against the outer surface of sill 84 at a point 146. In this manner, a visual gap between lineal 32 and sill 84 at point and/or line 146 is minimized or eliminated.

Referring to FIG. 16-20 another embodiment of a fenestration assembly includes a trim frame 152 operatively secured to fenestration frame 12. The trim frame includes a lineal header 154, two lineal members 156 and 158 and a bottom sill lineal 160. Similar to the embodiment discussed above and illustrated in FIGS. 1-5, the four lineal members have miter cuts and each end of a lineal member is secured to a respective end of an adjacent member with a corner key 36. However in one embodiment a pair of corner key connectors are positioned in each corner operatively connecting adjacent lineal members. The corner keys may nestle one in the other to fit into the hollow interior of adjacent lineal members. The use of two or more corner keys provides increased strength and/or rigidity to the assembled trim frame. A first set of fasteners extends through aperture 170 of lineal 160 and aperture 174 of lineal 158 and threadably received in a first corner key. Similarly, a second set of fasteners extends through aperture 168 of lineal 160 and aperture 172 and connected to the second corner key 36 that is located proximate the outer corner of the mating interface of lineal 160 and lineal 158. In a similar manner the other three corners of frame 152 are secured with two corner keys in each corner.

Referring to FIGS. 21-25 a fenestration assembly 200 includes a fenestration trim frame 202 operatively secured to a fenestration frame 12. Fenestration trim frame 202 includes four lineal members 204, 206, 210 and 208 secured together with butt joints. Each corner of fenestration frame 202 is secured with a connector 212 or 214. Connectors 212 and 214 are mirror images of one another. Referring to FIG. 23 a first connector 212 is used to secure one end of the lineal 208 to one end of lineal 210 and connector 214 is used to secure the second end of lineal 210 with one end of lineal 204. The operation of each connector 212 and 214 are similar.

Connector 212 includes a first portion having an end cap 242 and a second portion 248 extending from end cap 242. Second portion 248 includes a first longitudinal connector 232 and a second longitudinal connector 234. First portion 242 is fit over the open end of the hollow terminal end 336 of lineal 208. Referring to FIG. 52 and FIG. 53 tab members extend from end cap 242 into the hollow region 336 of lineal 208 and help to frictionally engage connector 212 with the walls of corresponding features in the hollow interior 336 of lineal 208. Second portion is positioned above lineal 208 and longitudinal connectors 232 and 234 extend into the hollow interior region of lineal 210. In order to have a butt joint between lineal 208 and lineal 210 with no horn a first fastener extends through aperture 226 in lineal 210 and a received within an aperture in first longitudinal connector 232. Similarly, a second fastener such as a screw extends through a second aperture 228 in lineal 210 and is received within an aperture in second longitudinal connector 234.

Figure 25:
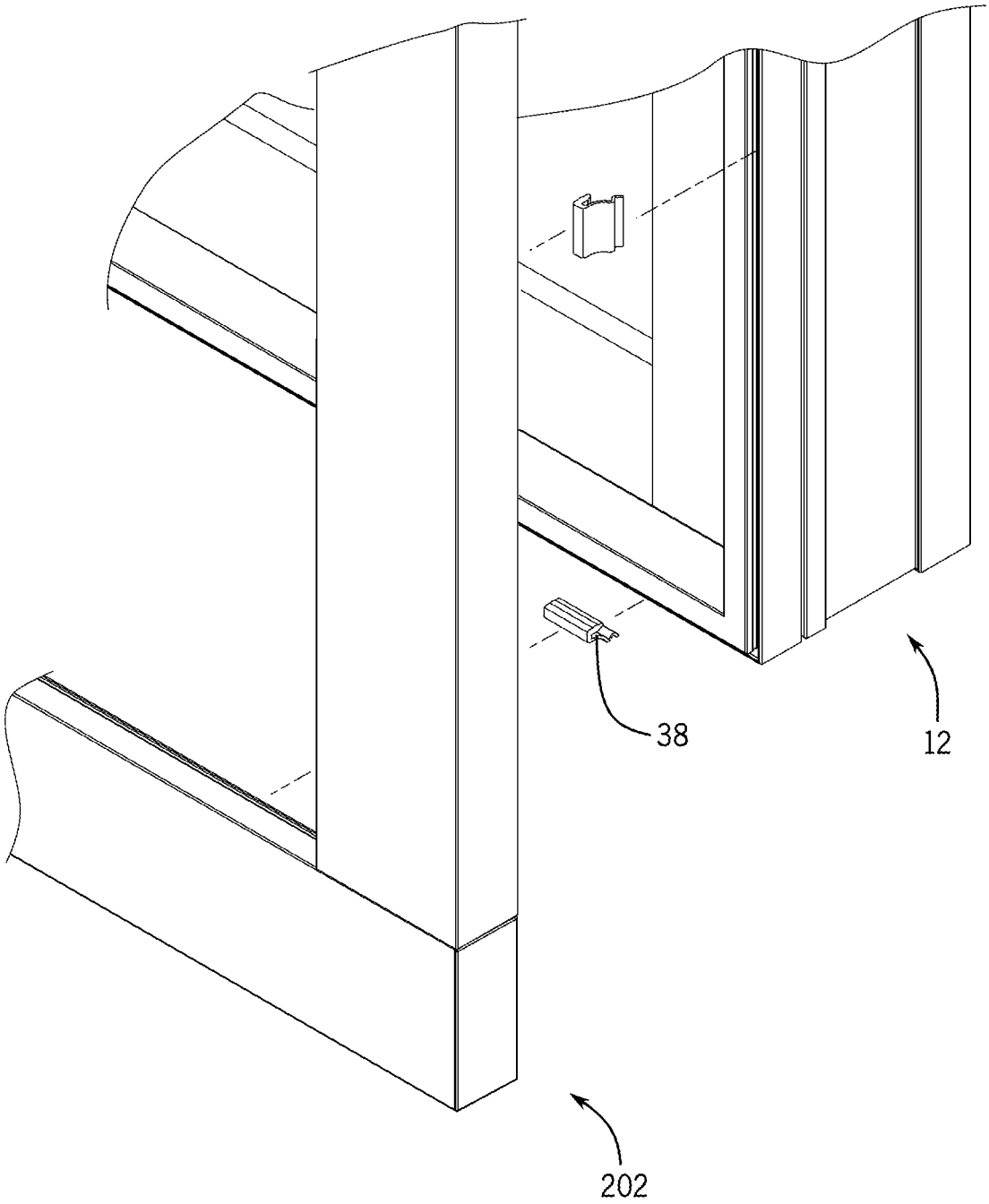
FIG. 25 is a partial exploded view of the assembled trim, clips and fenestration frame of FIG. 21.
Figure 26:
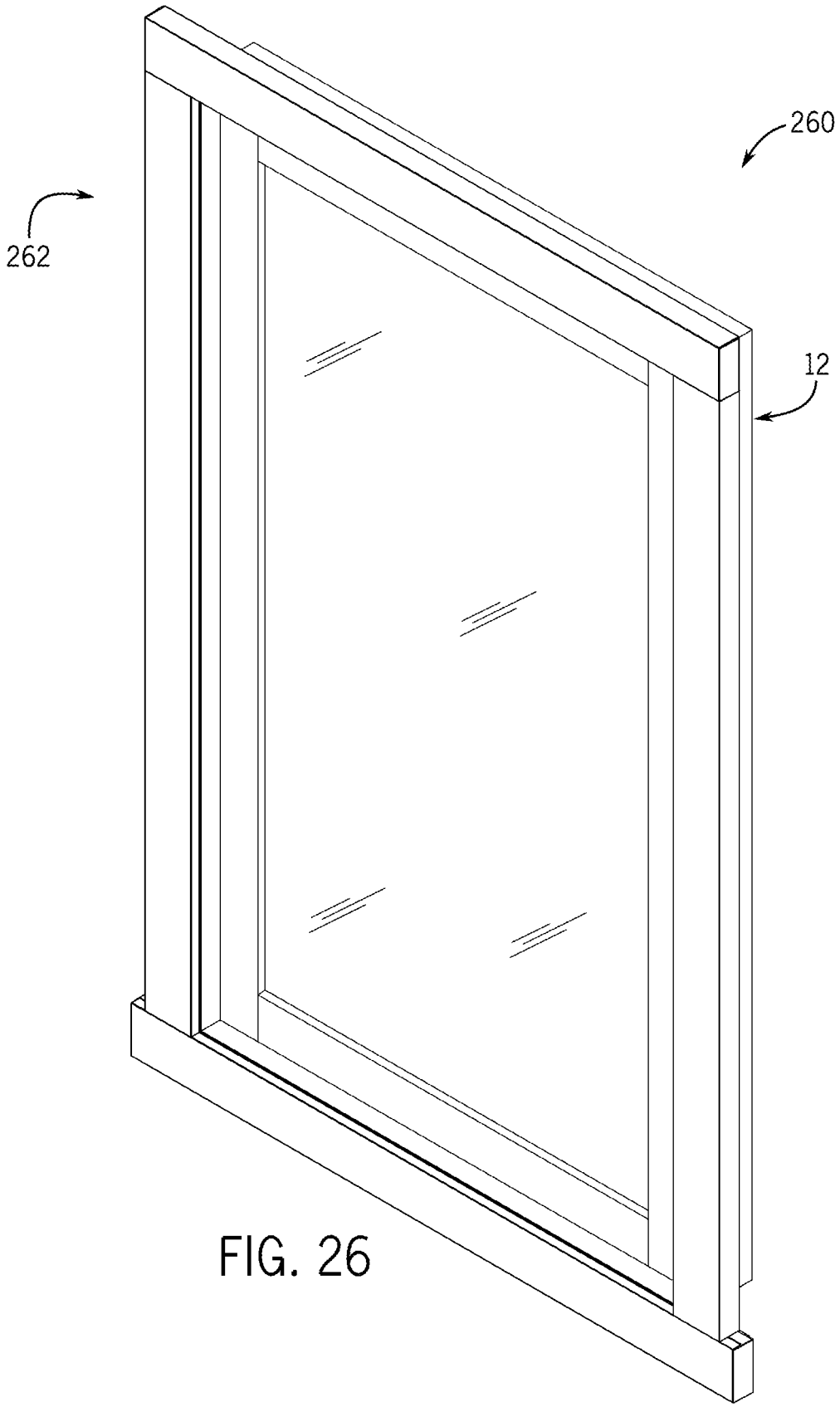
FIG. 26 is an isomeric view of another embodiment of a fenestration trim assembly with butt joints and a sill horn secured to a fenestration frame.
Figure 27:
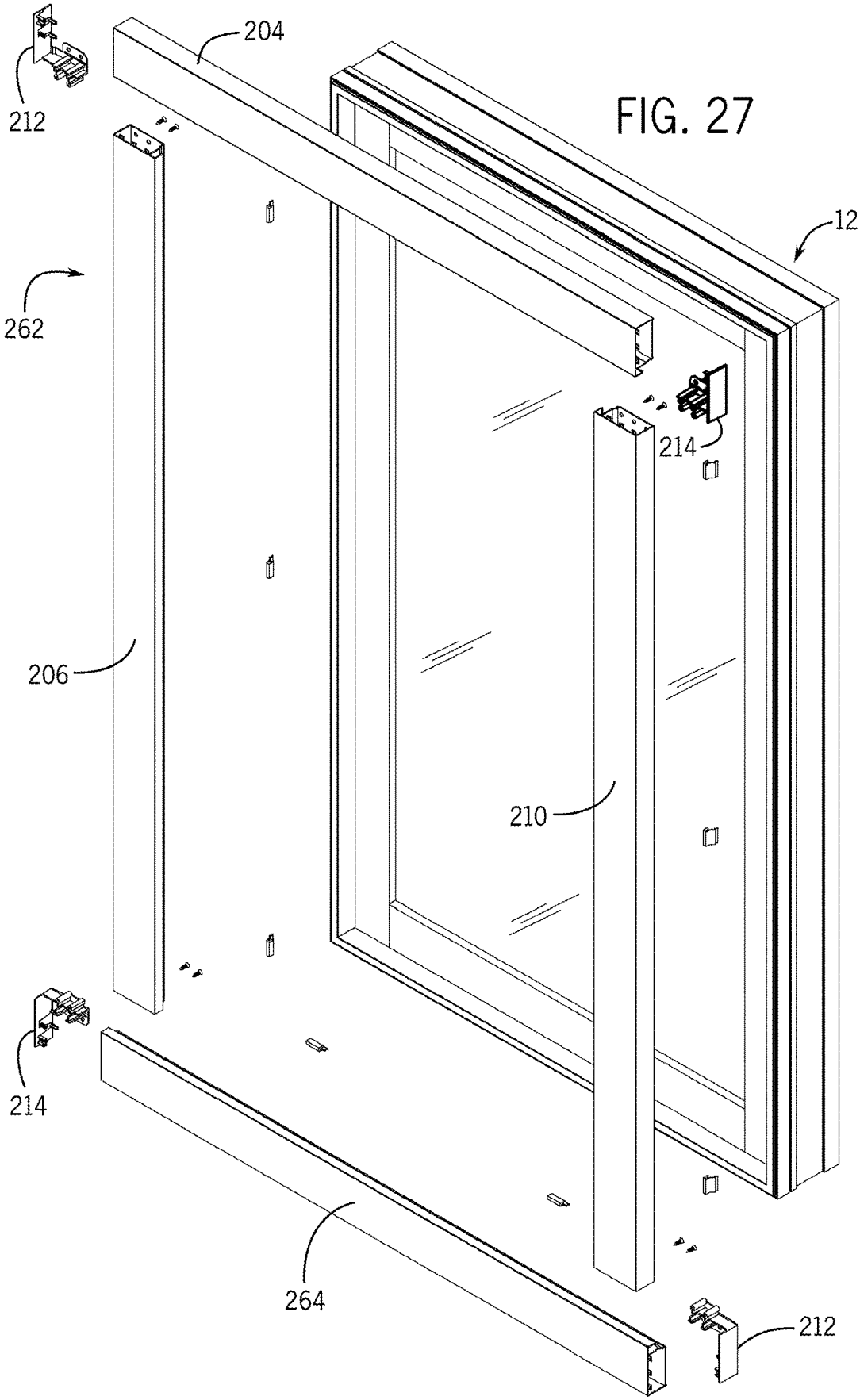
FIG. 27 is an exploded view of the fenestration trim assembly and frame of FIG. 26.

Similarly connector 214 first end cap portion covers the hollow interior 238 of lineal 204 and second portion 246 includes a first longitudinal connector 216 and a second longitudinal connector 218. A first fastener such as a screw extends through an opening 220 of lineal 210 proximate the end of lineal 210 distal from lineal 208 and into longitudinal connector 216 of connector 214. Similarly, a second fastener extends through an opening or aperture 232 of lineal 210 and into longitudinal connector 218 of connector 214. Referring to FIG. 24 lineal 210 is secured to lineal 208 and lineal 204 with butt joints. The other two corners are similarly joined with another connector 212 and 214. Referring to FIG. 25 and FIG. 54 fully assembled fenestration frame 202 is operatively secured to fenestration frame 12 with a plurality of clips 38 as discussed above. In another embodiment longitudinal connectors 232 and 234 may extend from a base member in a direction away from the header lineal or the sill lineal. Similar to the connector 148 illustrated in FIG. 51A it is possible to provide an angle to the member from which longitudinal connectors 232 and 234 extends to bias the outwardly facing surfaces of adjacent lineal members toward one another to reduce and/or eliminate any gap between adjacent lineal members. The fasteners that secure the corner key members 212 to the lineal members extend into the lineal members from the interior facing surface of the lineal members. In this manner the outwardly facing surface of the lineal members that a user would see when facing the fenestration assembly appears to be neat and free of any fasteners.

Figure 28:
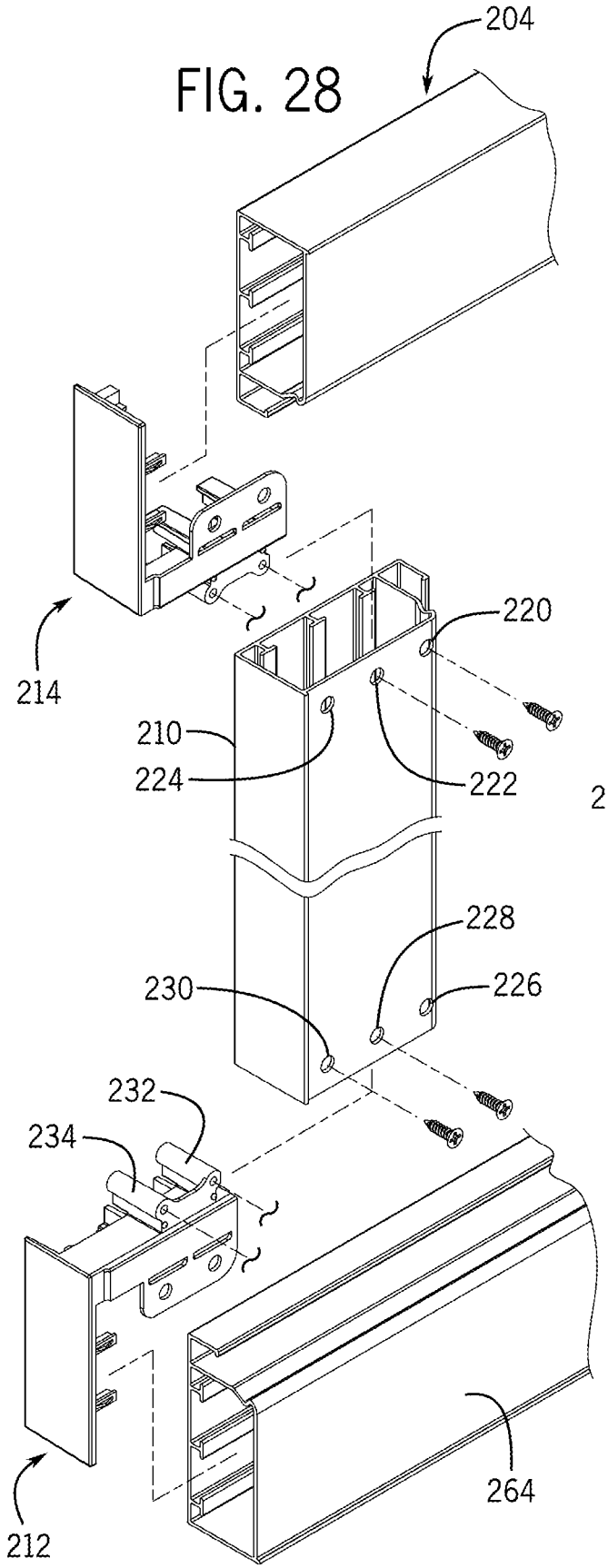
FIG. 28 is a partial exploded view of three lineal members and two corner keys of FIG. 26.
Figure 29:
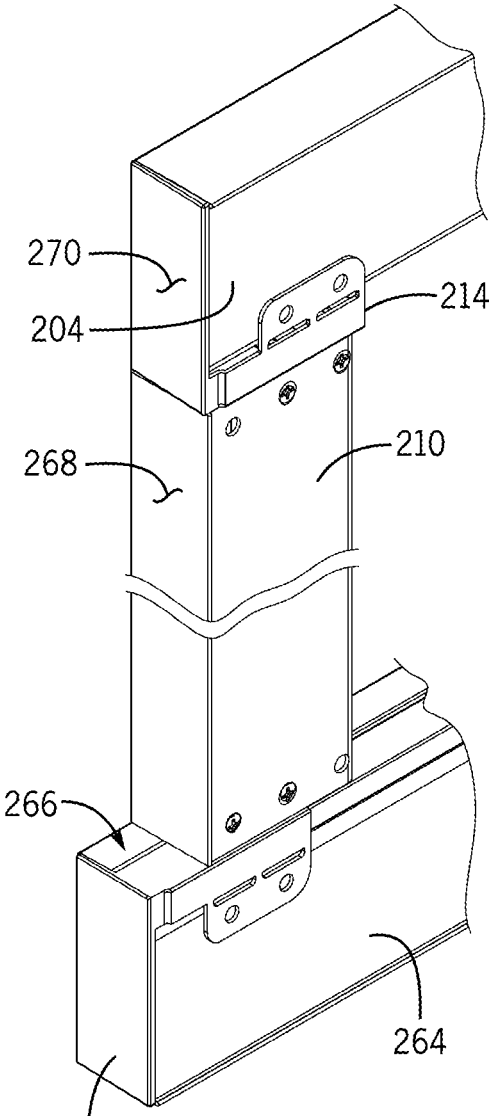
FIG. 29 is a partial isometric view of two lineals secured together with the corner key of FIG. 28.
Figure 30:
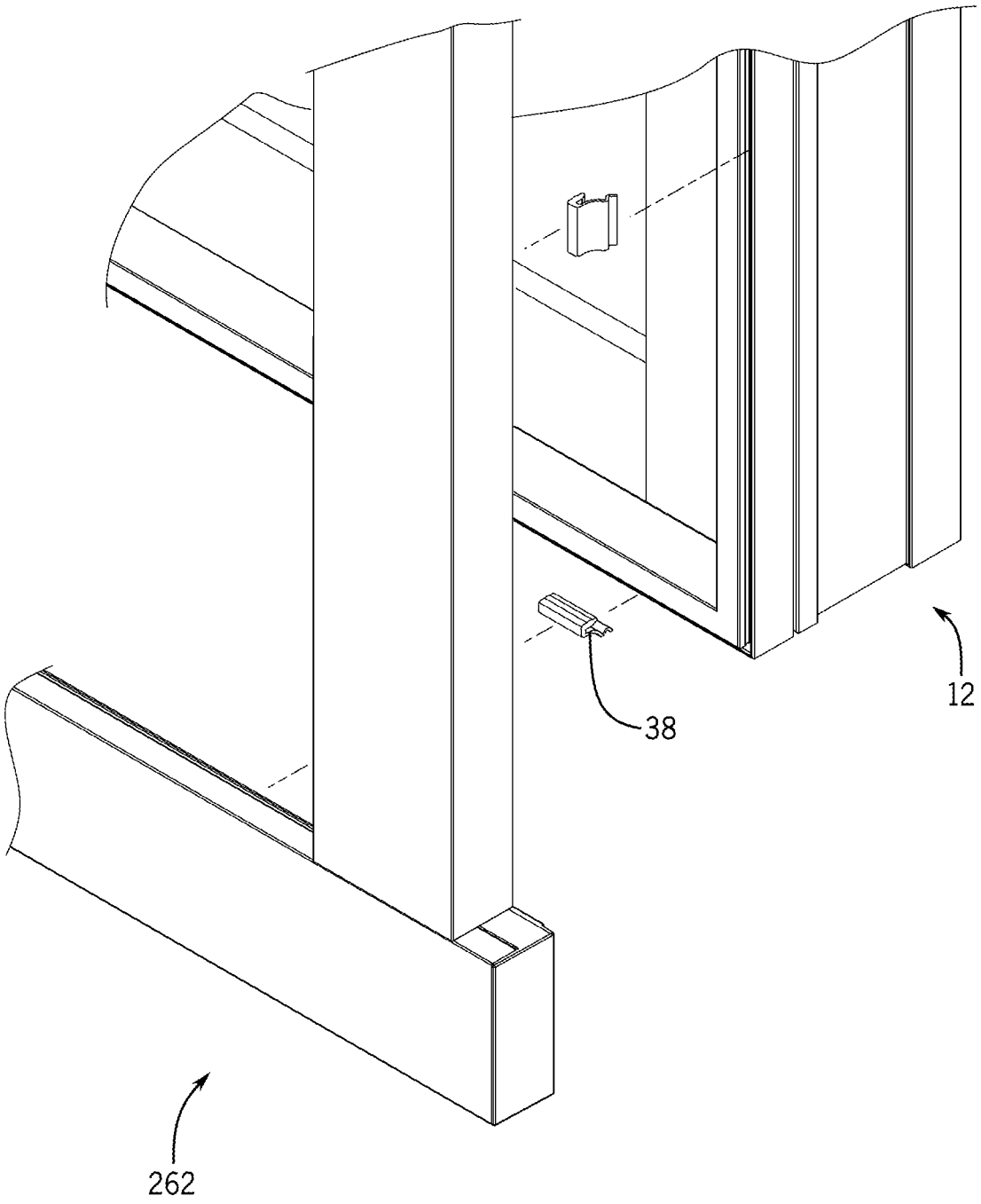
FIG. 30 is a partial exploded view of the assembled trim, clips and fenestration frame of FIG. 26.
Figure 31:
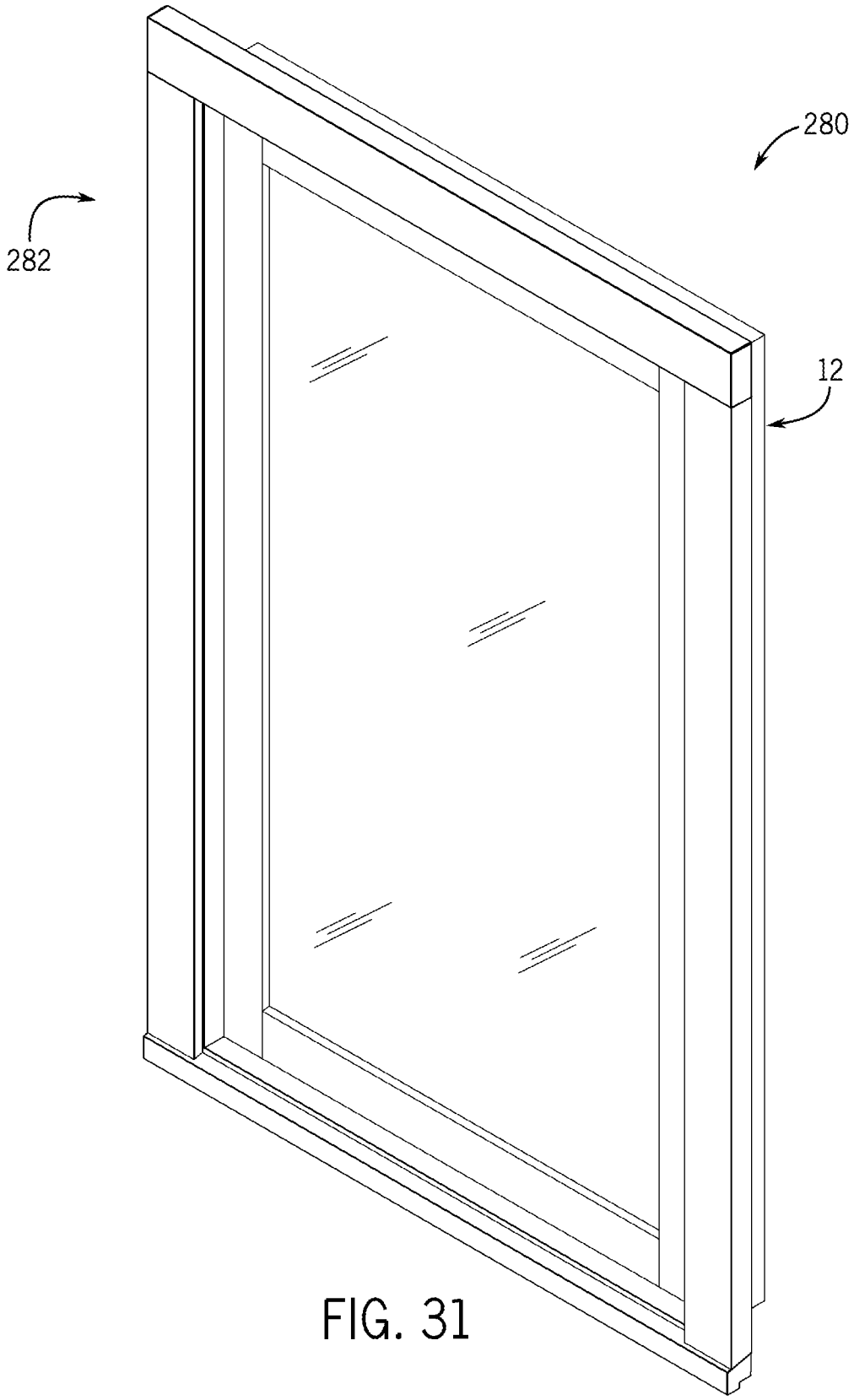
FIG. 31 is an isomeric view of another embodiment of a fenestration trim assembly with three lineals and a sill secured together with butt joints secured to a fenestration frame.
Figure 32:
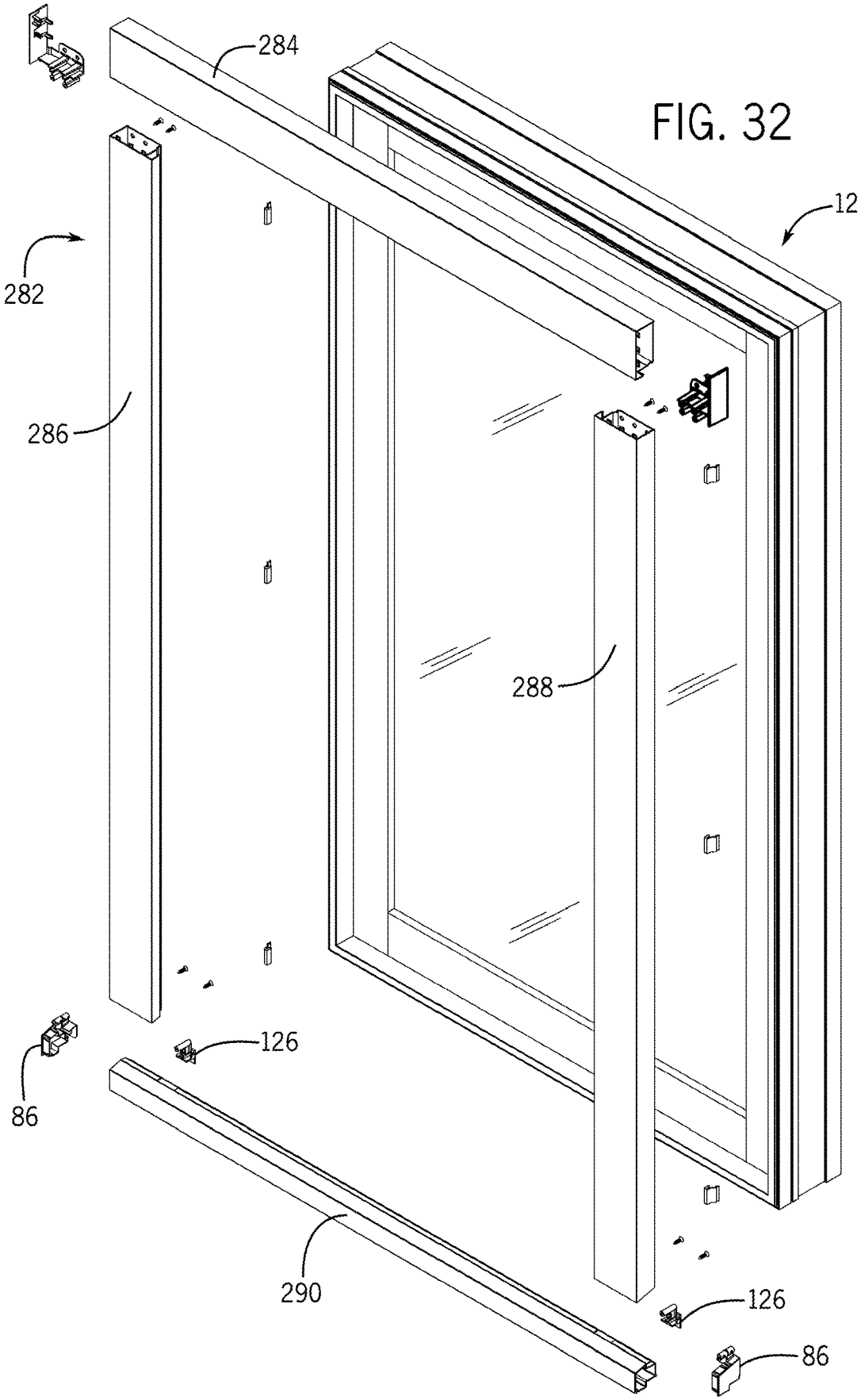
FIG. 32 is an exploded view of the fenestration trim assembly and fenestration frame of FIG. 31.
Figure 35:
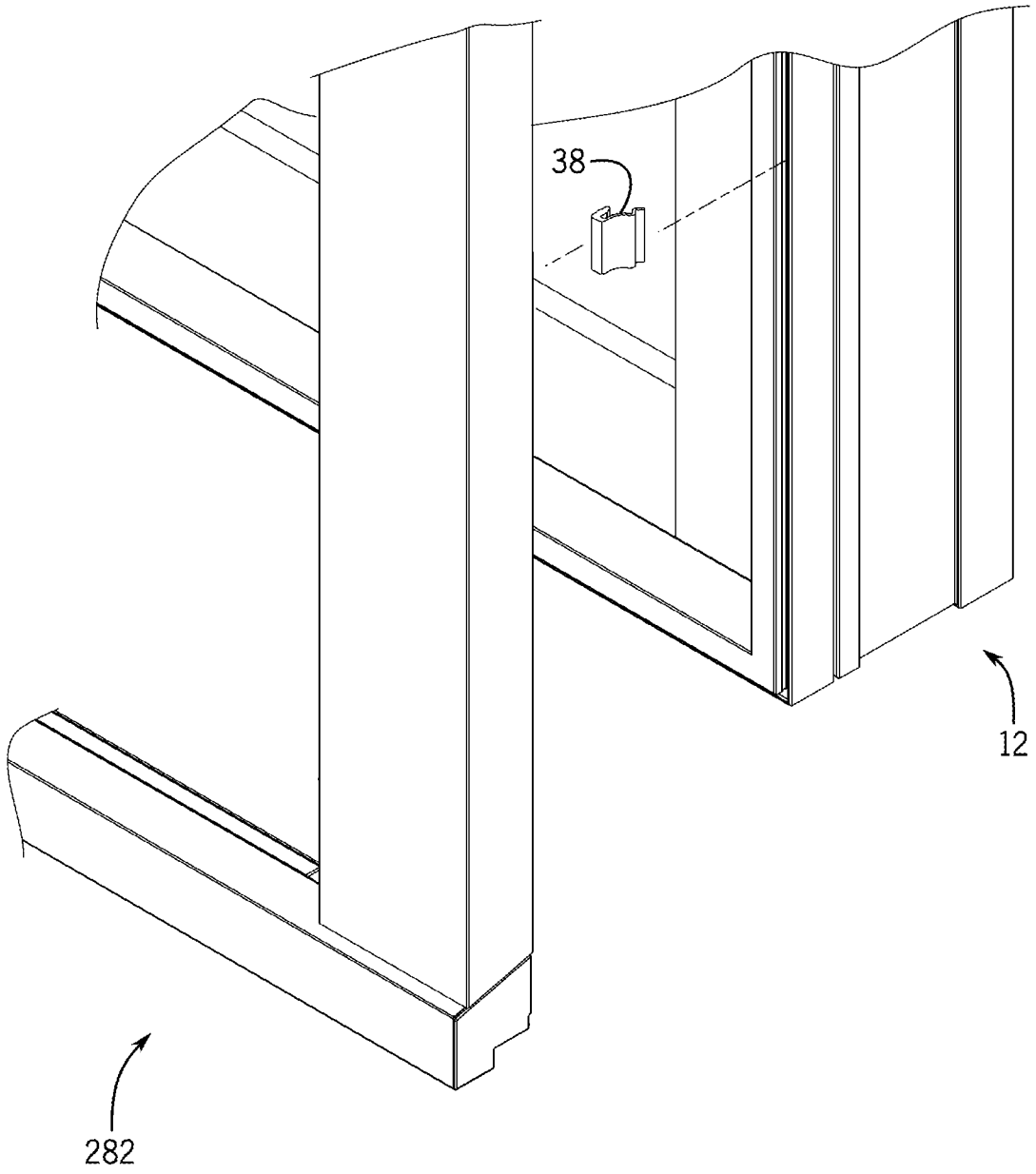
FIG. 35 is a partial exploded view of the assembled trim, clips and fenestration frame of FIG. 34.
Figure 36:
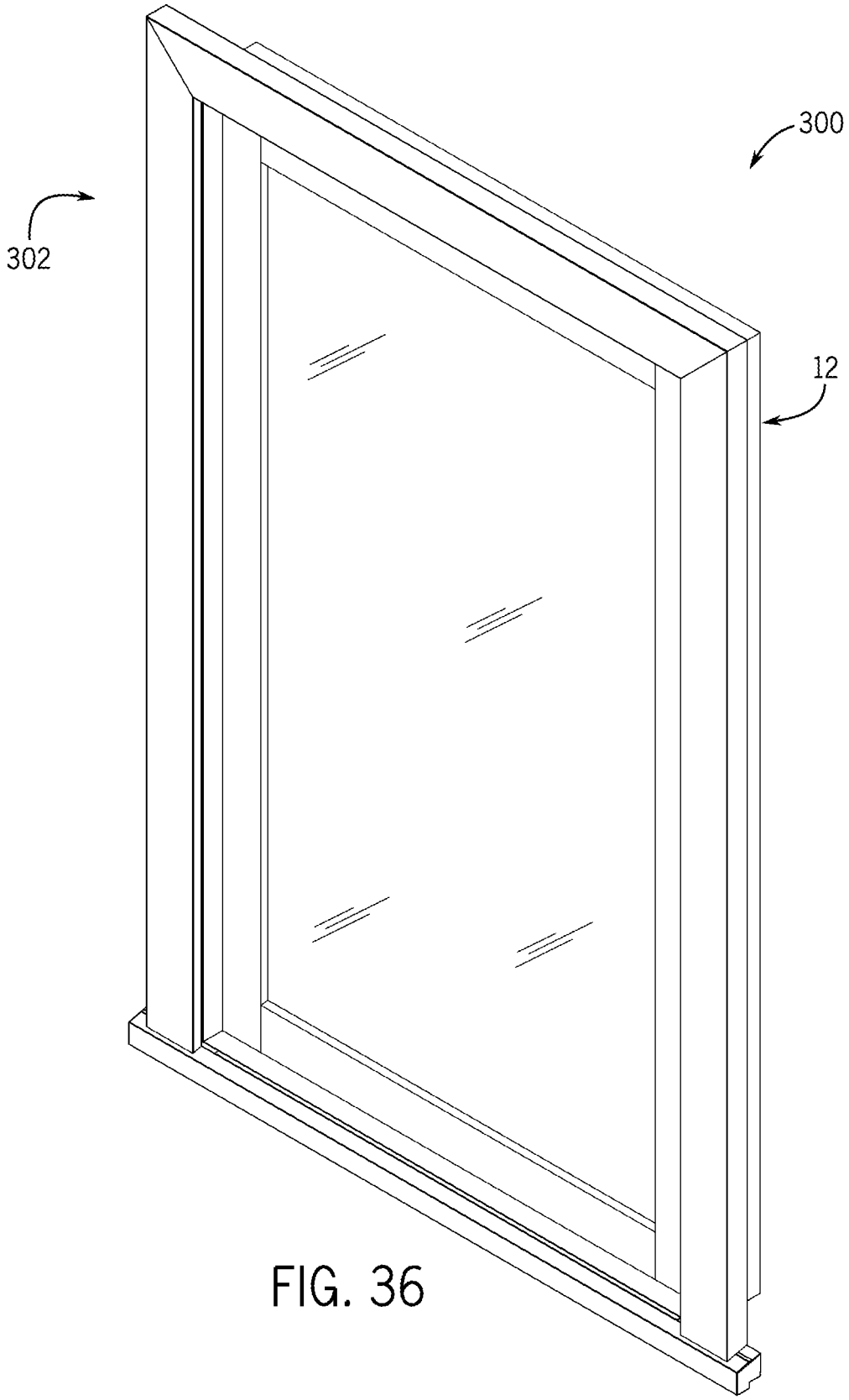
FIG. 36 is an isomeric view of another embodiment of a fenestration trim assembly with miter joints and a sill horn secured to a fenestration frame.
Figure 37:
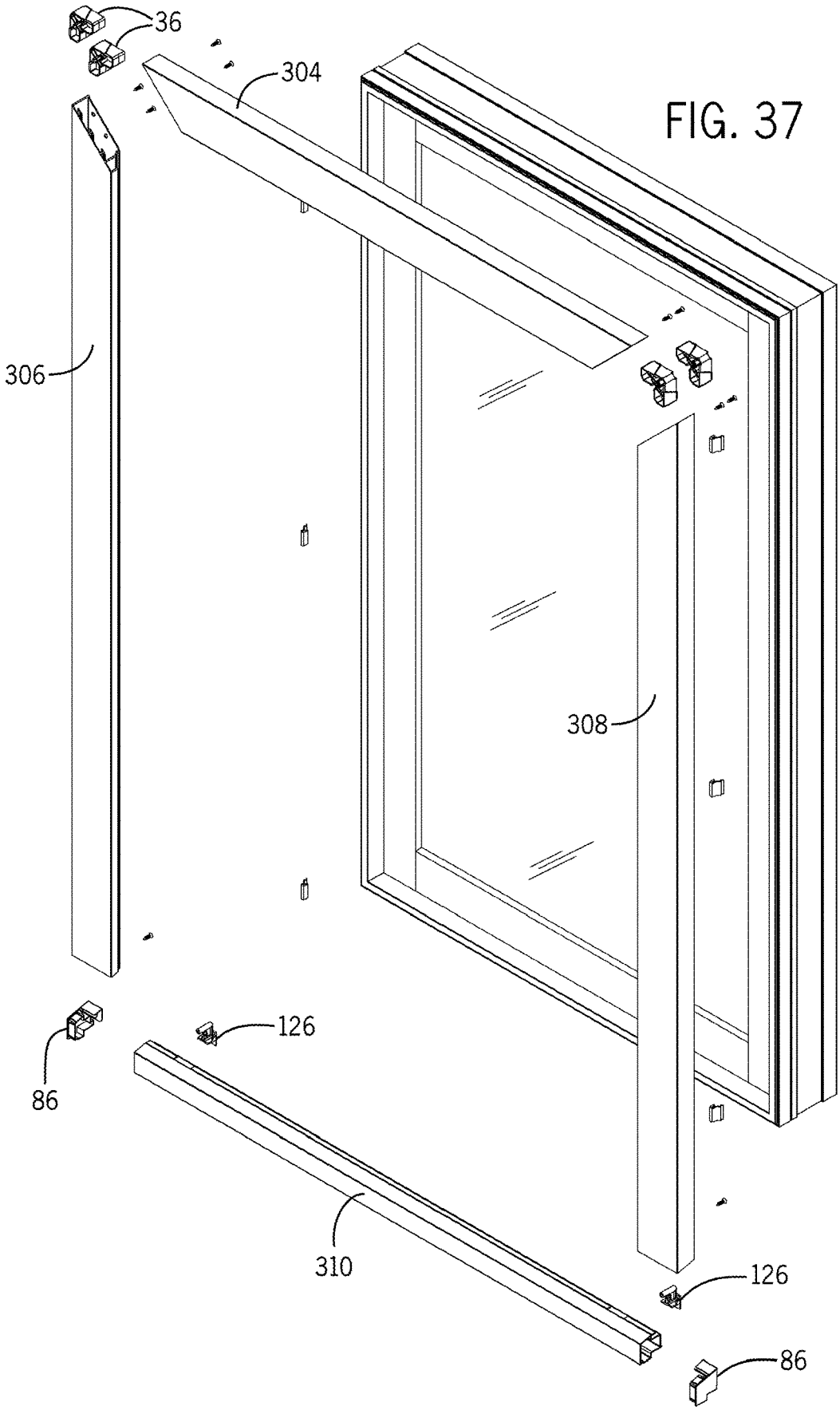
FIG. 37 is an exploded view of the fenestration trim assembly and fenestration frame of FIG. 36.
Figure 38:
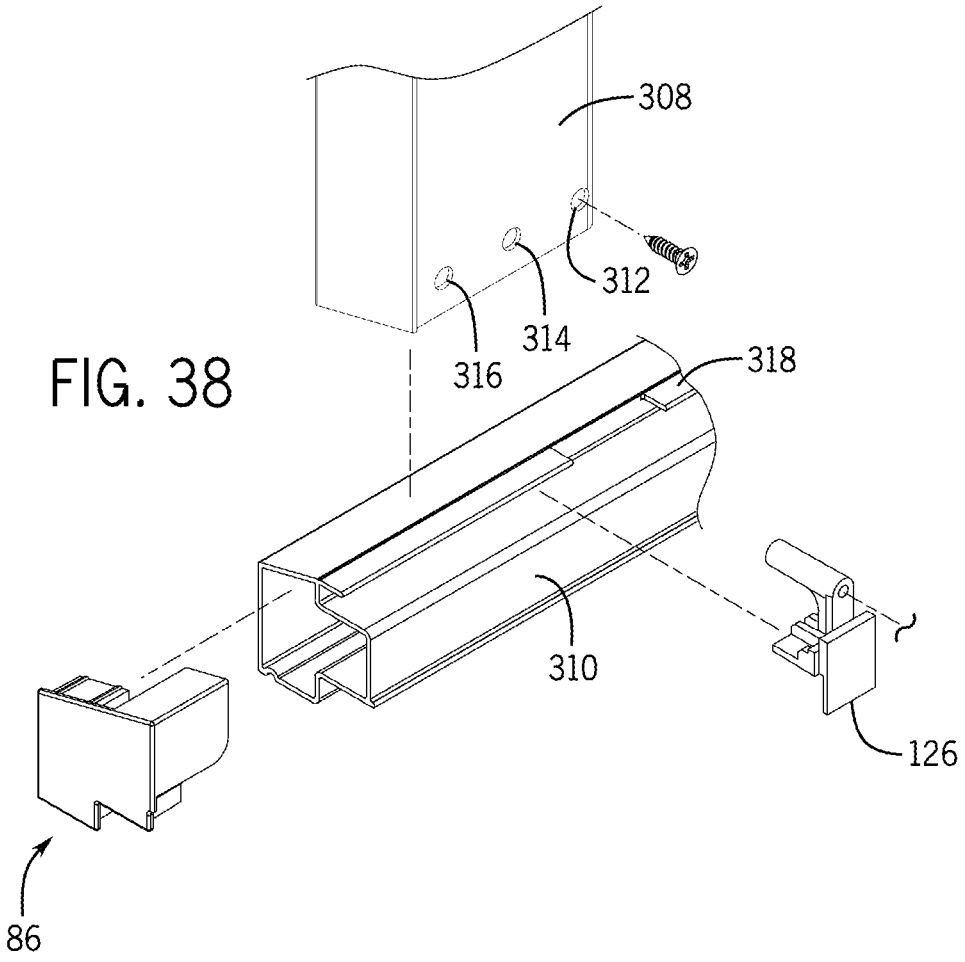
FIG. 38 is a partial exploded view of a lineal member, end cap and connector of FIG. 36.
Figure 39:
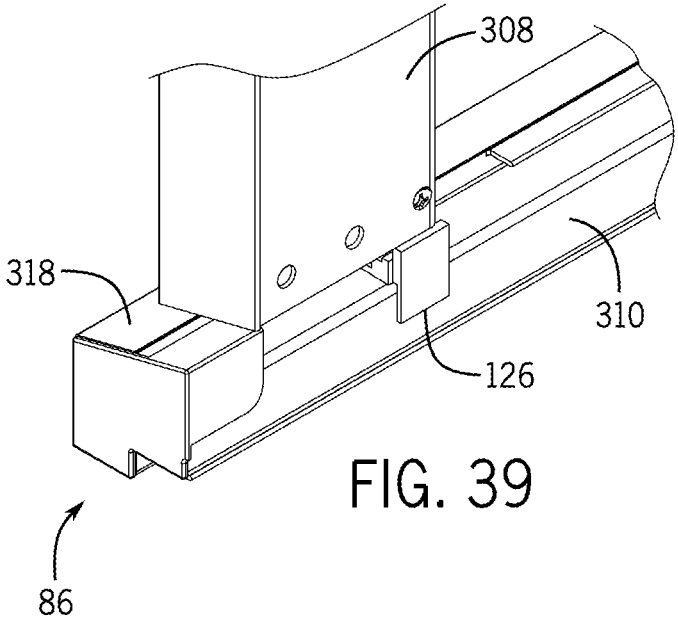
FIG. 39 is a partial isometric view of the lineal, sand sill secured together with the end cap and connector of FIG. 38.
Figure 40:
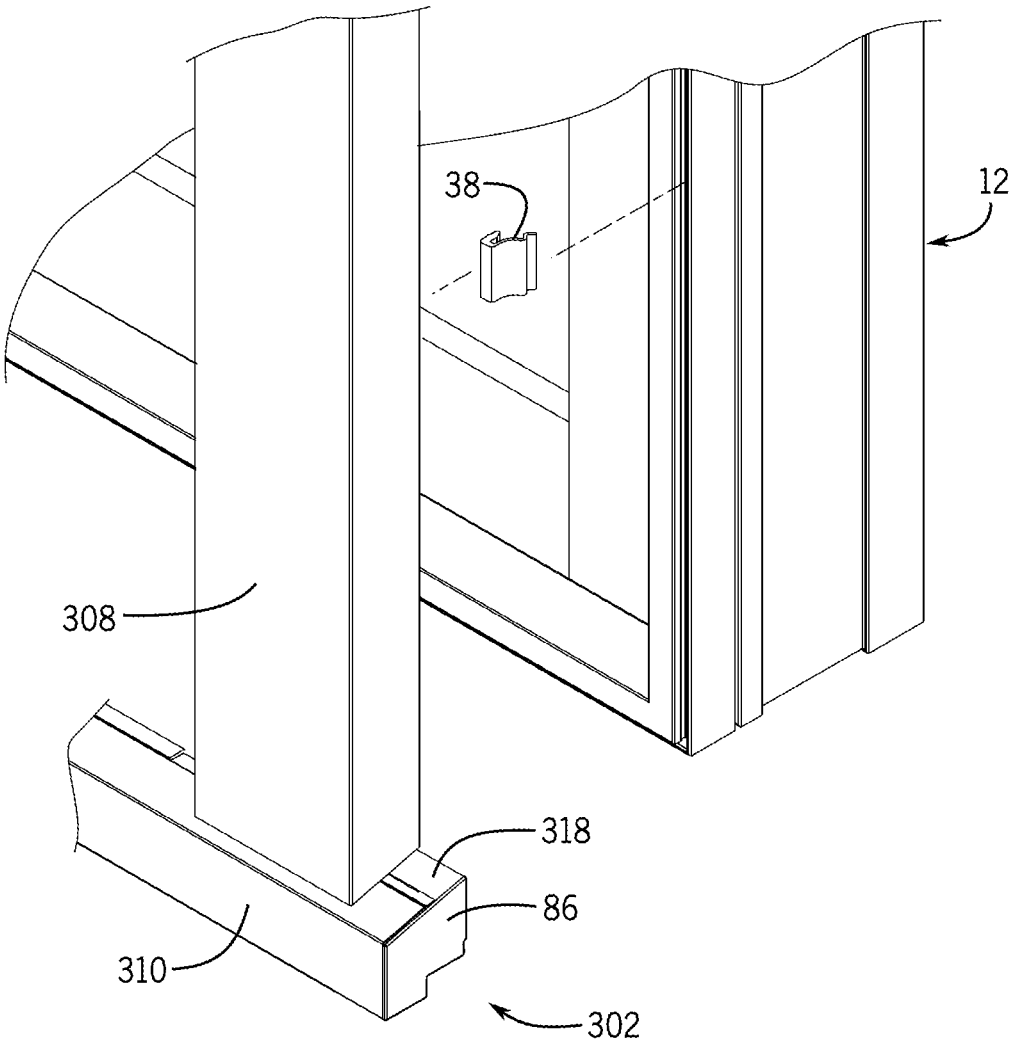
FIG. 40 is a partial exploded view of the assembled trim, clips and fenestration frame of FIG. 36.
Figure 41:
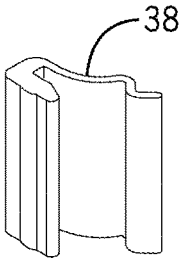
FIG. 41 is an isometric view of a clip used to secure a trim assembly to a fenestration frame.
Figure 42:
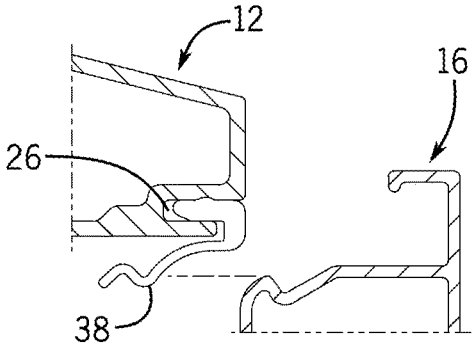
FIG. 42 is an exploded cross sectional view of a trim assembly, clip and fenestration frame.
Figure 43:
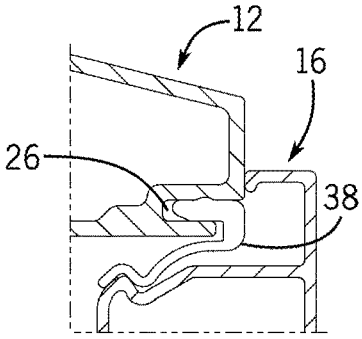
FIG. 43 is a cross sectional view of an assembled trim assembly, clip and fenestration frame of FIG. 42.

Referring to FIGS. 26-30 a fenestration assembly includes a fenestration frame 262 that includes the same components as fenestration frame 202 as discussed above. However by using different apertures in lineal members 206 and 210 in addition to the butt joints the sill may be provided with a horn 266. Referring to FIG. 28 longitudinal connectors 232 and 234 of corner key 212 is operatively aligned with apertures 228 and 230. In this manner horn portion 266 may be formed.

Referring to FIGS. 32-35 a fenestration trim frame 282 includes a combination of features described above. Specifically, header lineal 284 is secured to lineal members 286 and 288 with a butt joint using connectors 212 and 214 discussed above, while lineal members 286 and 288 are secured to a nose sill 290 with end cap connector 86 and separate connector 126 or connector 148. In this manner various combination of lineal members, butt or miter joints and types of sills may be attached to one another to form various fenestration frame assemblies. For example in FIGS. 36-40 a fenestration assembly 300 includes a trim frame 302 including a header lineal with miter cuts is operatively secured to miter cut lineal members 306 and 308 with two corner keys 36 at each corner. The other ends of lineals 306 and 308 can be butt joined to a nose sill 310 with an end cap connector 86 and a lineal connector 126 or connector 148.

Figure 55:
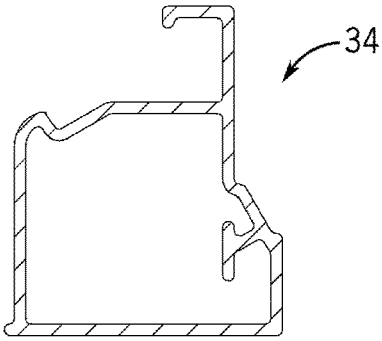
FIG. 55 is a cross sectional view of the lineal of FIG. 3.
Figure 56:
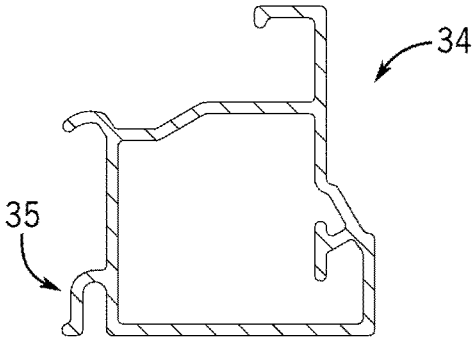
FIG. 56 is a cross sectional view of the lineal of FIG. 3 with an additional groove.
Figure 57:
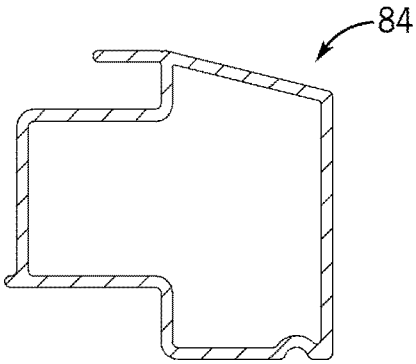
FIG. 57 is a cross sectional view of the sill nose of FIG. 8.
Figure 58:
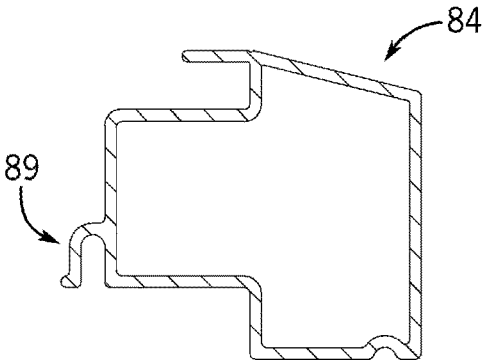
FIG. 58 is a cross sectional view of the sill nose of FIG. 8 with an additional groove.
Figure 59:
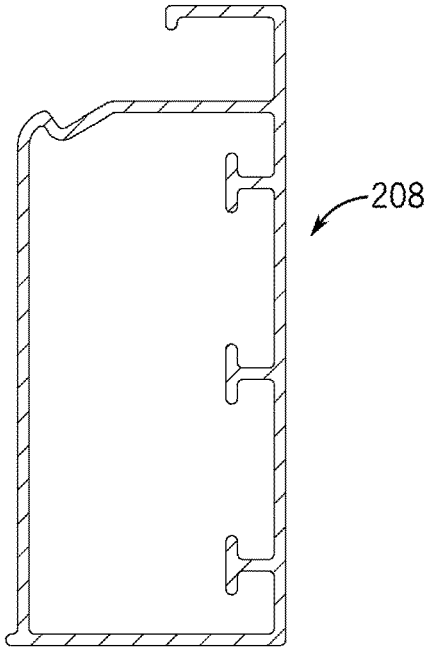
FIG. 59 is a cross sectional view of the lineal of FIG. 28.
Figure 60:
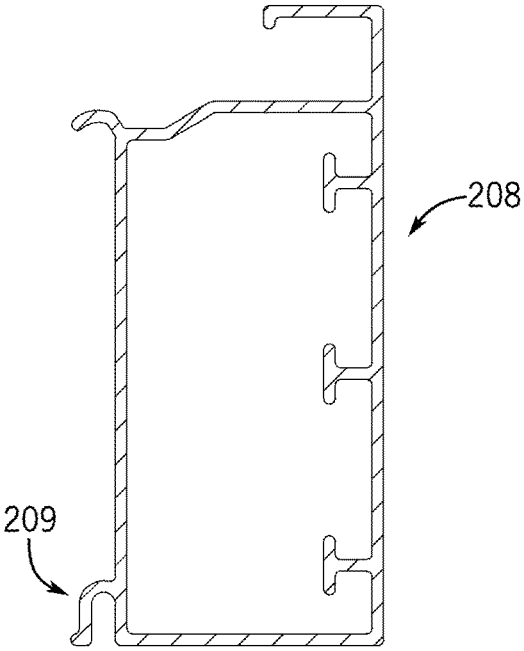
FIG. 60 is a cross sectional view of the lineal of FIG. 28 with an additional groove.

Referring to FIG. 55, FIG. 57 and FIG. 59 A cross-section of lineal 34, 84 and 208 is respectively illustrated. Referring to FIG. 56, FIG. 58 and FIG. 60 it is also possible to provide another groove 35, 89 and 209 respectively on lineals 34, 84 and 208 to assist in the attachment of the trim frames to the building structure.

Referring to FIG. 65, FIG. 66, FIG. 67 and FIG. 68 a universal corner key 400 may be used to secure lineal members at an obtuse angle 444, an acute angle 446, a right angle 480 and at an angle of 180 degrees. Further one, two or more corner keys may be used to secure adjacent lineal members. By adjusting the orientation of the universal corner key with respect to the lineals that are being attached to one another it is possible to secure adjacent lineal members in different angular orientations.

Figure 63:
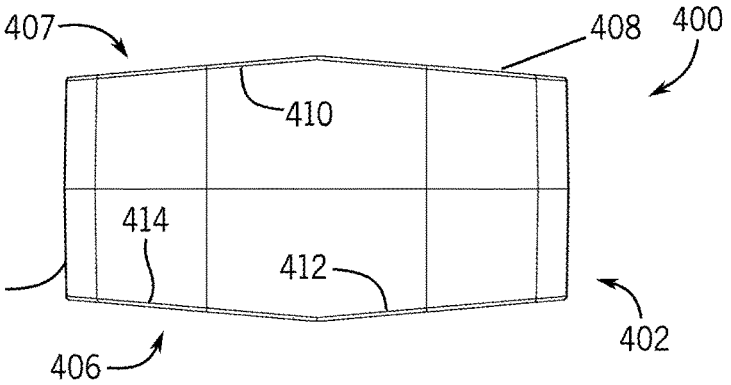
FIG. 63 is a side view of a universal corner key.
Figure 64:
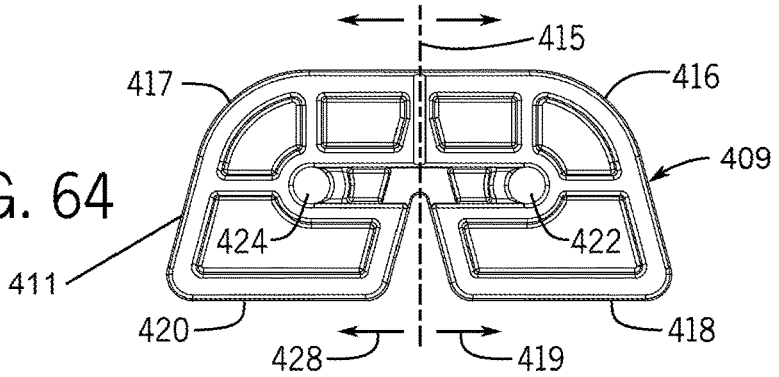
FIG. 64 is a top view of the universal corner key of FIG. 63.

Referring to FIG. 63 and FIG. 64 universal corner key 400 includes a first side 406 and as second opposing side 407. In one embodiment corner key 400 includes a center line 415 about which there are two portions that may be symmetrical. A top edge of universal corner key includes a first arcuate portion 416 and an opposing second arcuate portion 417. A sloping edge 409, 411 extends from respective arcuate portions 416, 417 and terminates in a respective bottom portion 418, 420. In one embodiment bottom portions 418, 420 are substantially co planar and may be substantially parallel with the top region between arcuate portions 416 and 417, Universal key 400 includes a first aperture 422 and a second aperture 424 extending side 406 toward side 407. As will be explained in further detail below surfaces 408, 410 and 412, 414 slope away from center line 415 at a predetermined angle.

Referring to FIG. 68 and FIG. 69 the operation of the universal clip to secure two lineals 460, 462 will be described. A portion of universal key 400 on one side of center line 415 is inserted into the hollow interior of lineal 460 and a second portion of universal key 400 on the opposite side of center line is inserted into the hollow interior of lineal 462. The surface 413 is adjacent interior wall 484 of lineal 460 while surface 405 of key 400 is adjacent interior wall 486 of lineal 462. A fastener 492 is inserted through an aperture in lineal 460 through the inwardly facing wall of the lineal. The inwardly facing wall of the lineal will be adjacent the fenestration frame when the fenestration trim frame is operatively secured to the fenestration frame. Fastener 492 is received within aperture 422 of universal key 400. Similarly, a fastener 490 such as a screw is inserted through an aperture in lineal 462 through the inwardly facing wall of lineal 462. Fastener 490 is received within aperture 424 of universal key 400. In one embodiment the distance between the center of apertures 422 and 424 is less than the distance between the aperture extending through lineal 460 and 462. In this manner as fasteners 492 and 490 are threaded into apertures 422 and 424 the terminal ends of lineal 460 and 462 are drawn toward one another to ensure a tight interface between lineal 460 and lineal 462.

Referring to FIG. 69 in one embodiment by design sloped face 413 and 405 extend away from surfaces 484 and 486 respectively at an angle 491. In one embodiment angle 491 is one degree, in another embodiment angle 491 is greater than two degrees and in a preferred embodiment angle 491 is between two and five degrees. As fasteners 492 and 490 tighten lineals 460 and 462 to universal key 400 surfaces 484 and 486 of lineals 460 and 462 will be drawn toward surfaces 413 and 405 of universal key 400. As a result a moment force will be created in which the lineals 460 and 462 will pivot toward one another such that the facing surfaces 483, 485 will form a tight connection with minimal gap at interface 487. In one embodiment the combination of differential distance between the universal key apertures 422, 424 and the distance between the corresponding apertures through lineal 460 and 462 and the angle between the adjacent surface of the universal key 413, 405 and surfaces 484 and 486 provide for a tight fit between the lineals that also minimize any gap between the outwardly interface 487.

In one embodiment universal key is symmetrical both in the direction perpendicular to center line 416 as well as along a plane that is mid-way between the first side 407 and 408. As a result the side that is secured to the inwardly facing surfaces of the lineals does not matter. However, it is also contemplated that the geometry of side 407 may be different than the side 408. It may be possible that the sloping angle of surfaces 408 and 410 is different than the sloping angle of surfaces 412 and 414. Depending on the application it may be desirable to have a greater slope and a user in the field could decide that one angle would be better to provide the proper fit and finish of the assembled fenestration trim frame. Further it is contemplated that the angle of the slope of surface 408 may be different than that of surface 407.

Referring to FIG. 63 and FIG. 64 surfaces 408 and 412 slope in a direction 419 way from center line 415 and surfaces 410 and 414 slope away from center line 415 in a direction 418. In one embodiment direction 418 and 419 are perpendicular to center line 415.

Figure 65:
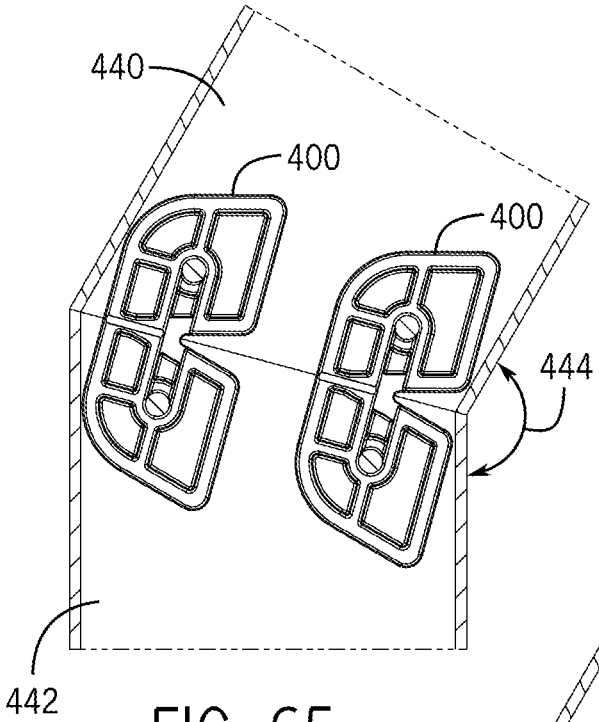
FIG. 65 is a partial cross sectional view of two lineals connected with a universal corner key at an obtuse angle.
Figure 66:
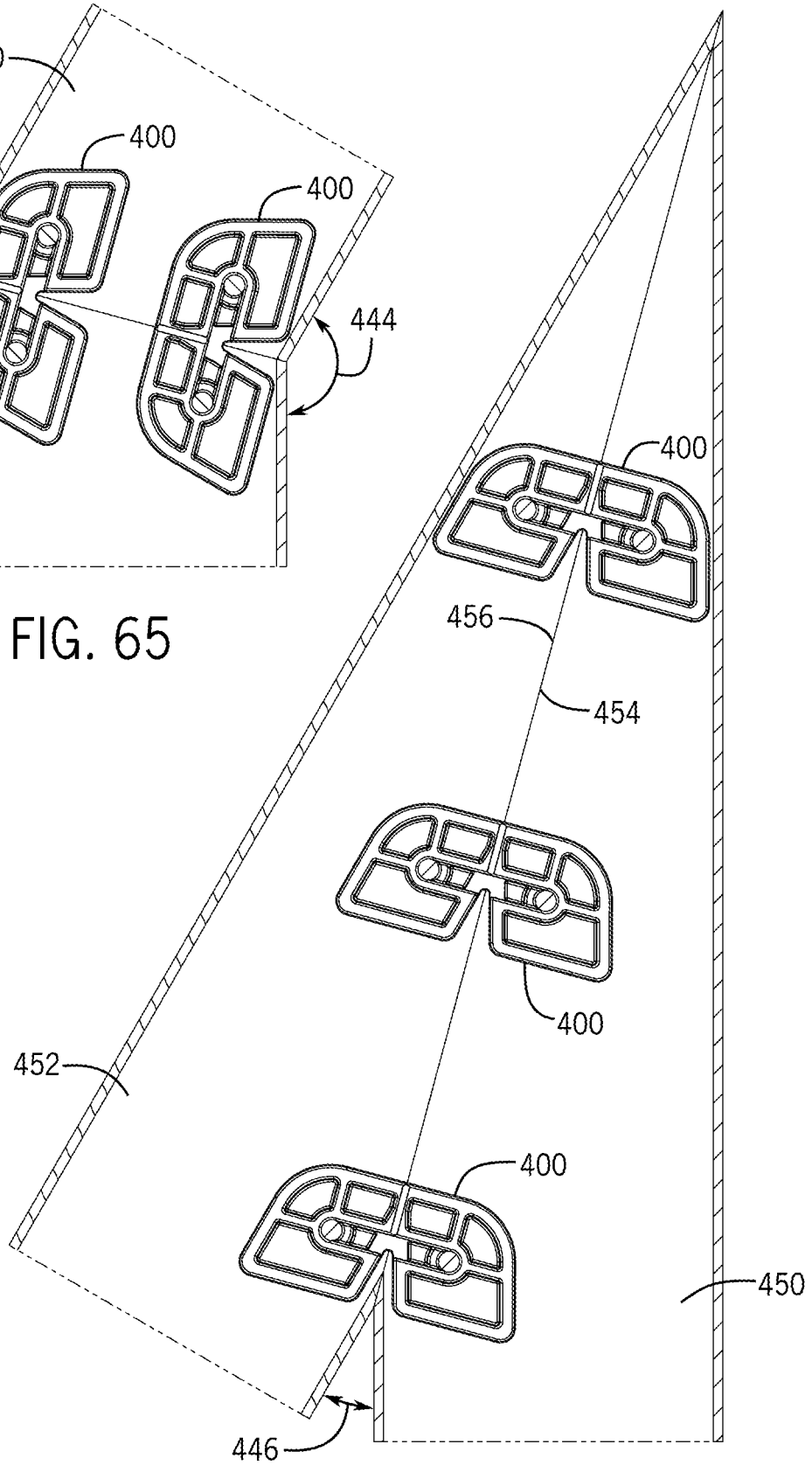
FIG. 66 is FIG. is a partial cross sectional view of two lineals connected with a universal corner key at an acute angle.

Referring to FIG. 66 lineal 450 and 452 are secured to one another with three universal keys 400. Universal key 400 is placed such that the center line 415 of each universal key is aligned with the mating edges 454, 456 of the adjacent lineals being secured. Referring to FIG. 65, FIG. 67 and FIG. 68 it can be seen that in one embodiment the center line 415 of each universal key is aligned with the mating surfaces of the lineals being secured to one another. Since universal key 400 has depth between the first side 407 and second side 408, center line 415 may be described as a plane that intersects the mating line of the lineals that are being joined regardless of angle that the longitudinal axis of a first lineal makes with respect to the longitudinal axis of the second lineal, when the first lineal is being joined to the second lineal.

Figure 70:
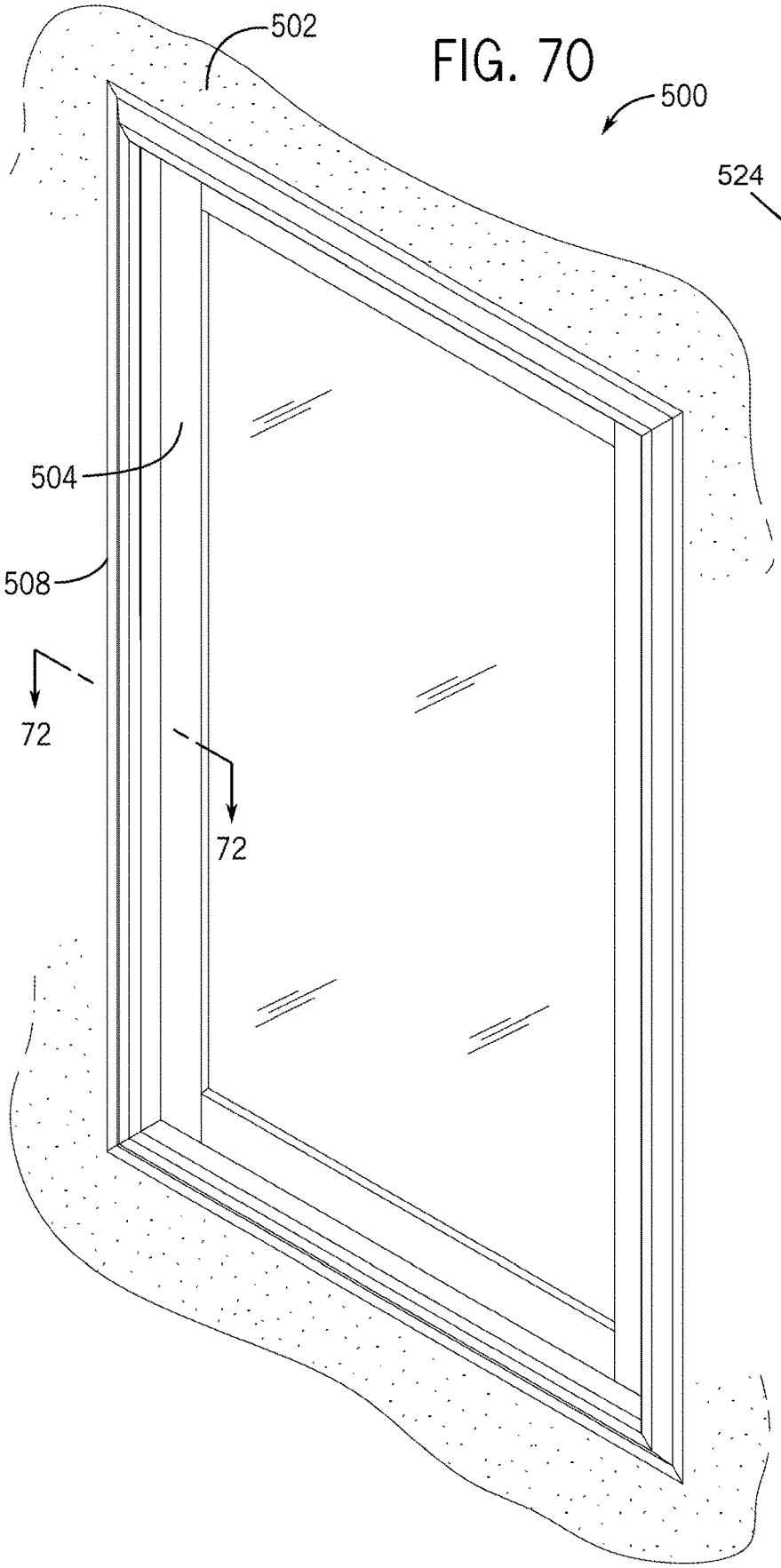
FIG. 70 is a fenestration assembly with a stucco key.
Figure 71:
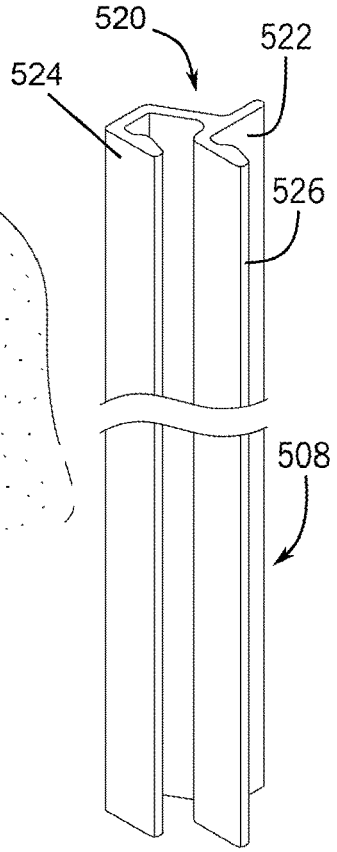
FIG. 71 is a first stucco key.

Referring to FIG. 70 and FIG. 71 fenestration assembly 500 includes a fenestration frame 504 and a stucco key 508. Stucco keys perform a number of functions. One function is to hide the crack that forms as stucco dries and pulls away from the edge of a window or door frame. A secondary application is covering the gap between the edge of a stucco "J" channel and a window or door frame. An installer may push stucco behind the key. They may also install a "J" channel, which the key covers up. There are many uses for a stucco key. A stucco key provides an aesthetic means of transitioning between a window or door frame and a stucco system.

Stucco siding for residential homes may be applied in the form of a traditional stucco or three coat stucco that may have a nominal thickness of one inch. Another type of stucco may be referred to as coat that has a nominal thickness of one and three eighths inches. Windows and Doors must protrude outward of a wall the nominal thickness of the stucco system for installers to properly finish a stucco installation. Both systems are prevalent in the residential market. A manufacturer must provide different part sizes for the two stucco thicknesses. Stucco key 508 described herein may be used for both applications.

In one embodiment, stucco key 508 provides for two different positions allowing for a one inch thickness of stucco and one and three eights inch of stucco with one key. The two position stucco key 508 may be used with different jamb and trim profiles. Stucco key 508 as discussed below may be easily removed and replaced after the window or door leaves the factory and may be installed on site by an installer.

A manufacturer typically attaches trim to a window or door through the face of the stucco key. The manufacturer or installer must then fill the indents around the fasteners before they can paint the trim. Conversely, if someone needs to remove the trim, the visible surfaces are difficult to repair. The stucco key described allows trim removal without marring painted surfaces.

Drawings 6&7 show a float applying the final stucco coat. The Lip is positioned to accept the final stucco thickness.

See darts and kerf on Drawing 10

See Drawing 13 for float direction

Figure 72:
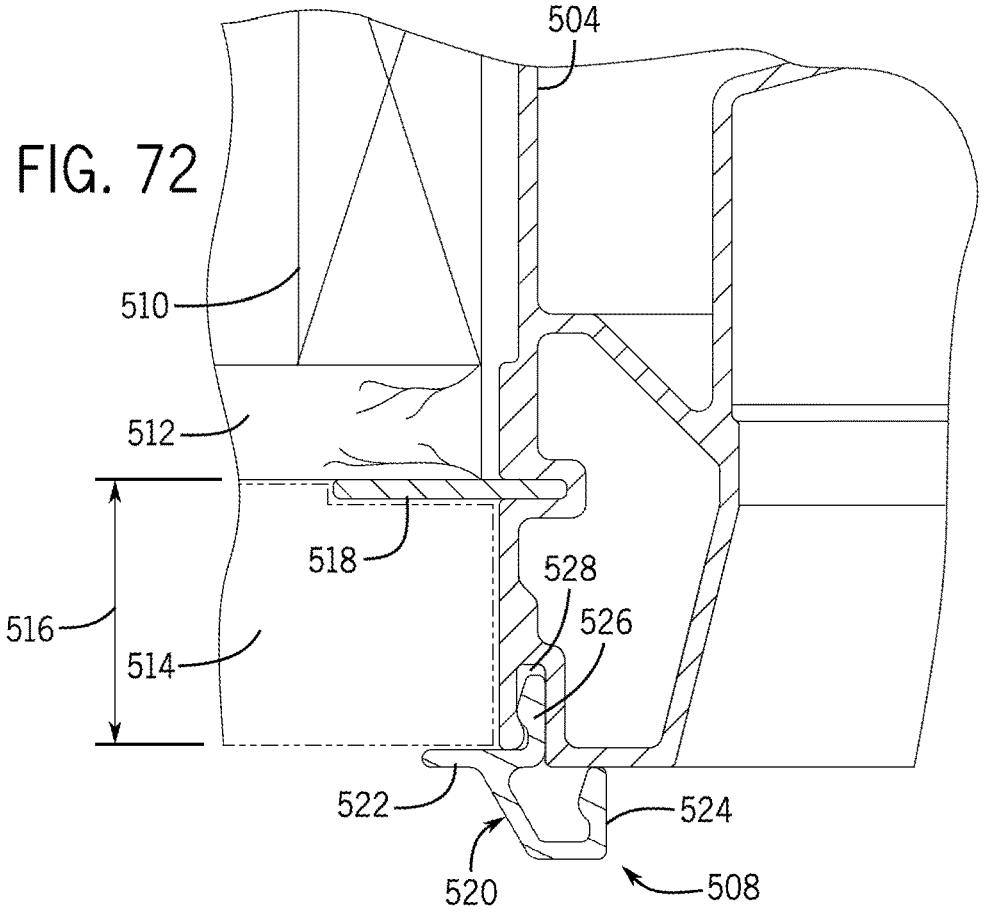
FIG. 72 is a cross section of a fenestration assembly with the first stucco key in a first orientation.

Referring to FIG. 71 stucco key 508 includes an elongate body 52 having a lip 522, first connecting leg 526 and a second connecting leg 524. Lip 522, leg 524 and leg 526. Referring to FIG. 72 frame 504 includes a groove 528 configured to received leg 524 or leg 526. Frame 504 is secured to a building having a structure such as studs 510 and outer skin such as plywood 512. A nail kerf 518 is secured to the outer skin 512.

Referring to FIG. 72 first leg 526 of stucco key 508 is positioned within groove 528 of frame 504. In this manner lip 522 extends a first distance 516 from the building structure. Stucco 514 is located between lip 522 and the building structure. IN this manner lip 522 hides and/or covers the interface between the stucco material and the frame.

Figure 73:
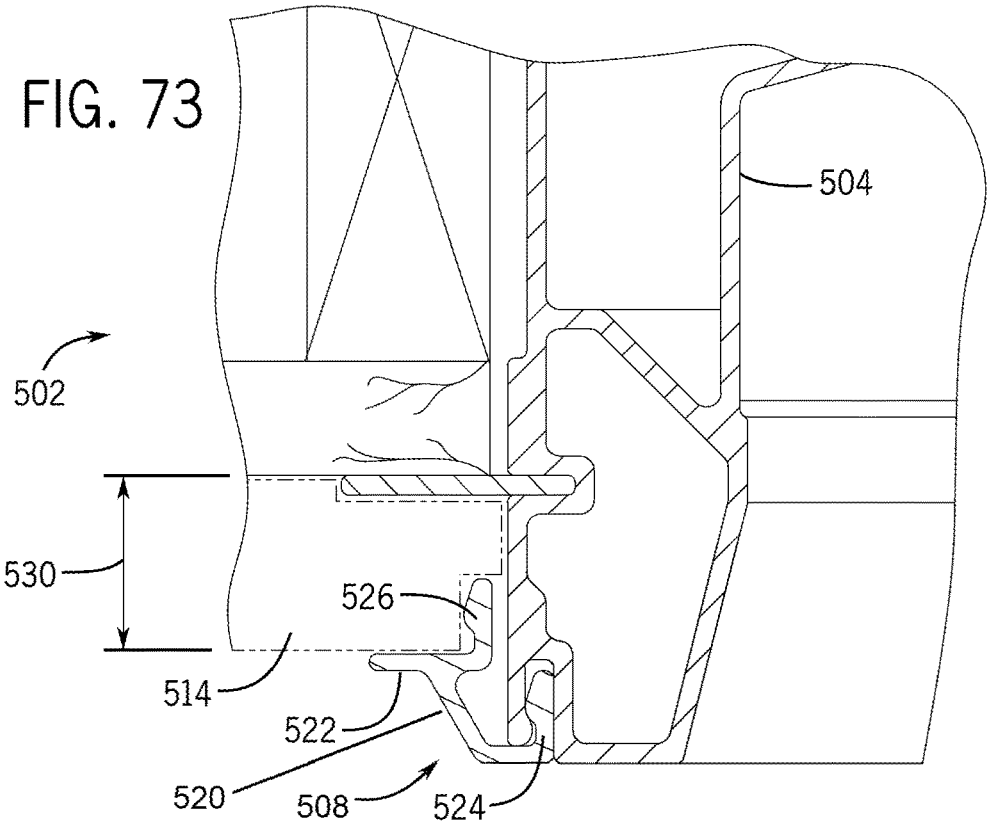
FIG. 73 is a cross section of a fenestration assembly with the first stucco key in a second orientation.

Referring to FIG. 73 second leg 524 of stucco key 508 is positioned within groove 528 of frame 509. In this second configuration lip 522 is positioned a distance 530 from the building structure. Note that distance 530 is less than distance 516. In the second configuration, first leg 526 is positioned outside of the frame. Stucco 514 is located between lip 522 and the building structure. In this second configuration the thickness of the stucco is the same distance 530. As with the first configuration lip 522 hides and/or covers the interface between the stucco material and the frame 504.

There a few differences in the resulting appearance of stucco key 508 when secured to frame 504 in the first and second configurations. First the terminal free end of lip 522 is further from frame 504 in the second configuration than in the first configuration. Second, the terminal free end of second leg 524 is adjacent an outwardly extending surface of frame 504 in the first configuration forming a decorative appearance about the frame 504. In the first configuration, the outwardly surface of the stucco key 508 is not co-planar with the outwardly surface of the frame. In contrast in the second configuration with leg 524 within groove 528, the outwardly surface of stucco key 508 is coplanar with the outwardly surface of frame 504.

Figure 74:
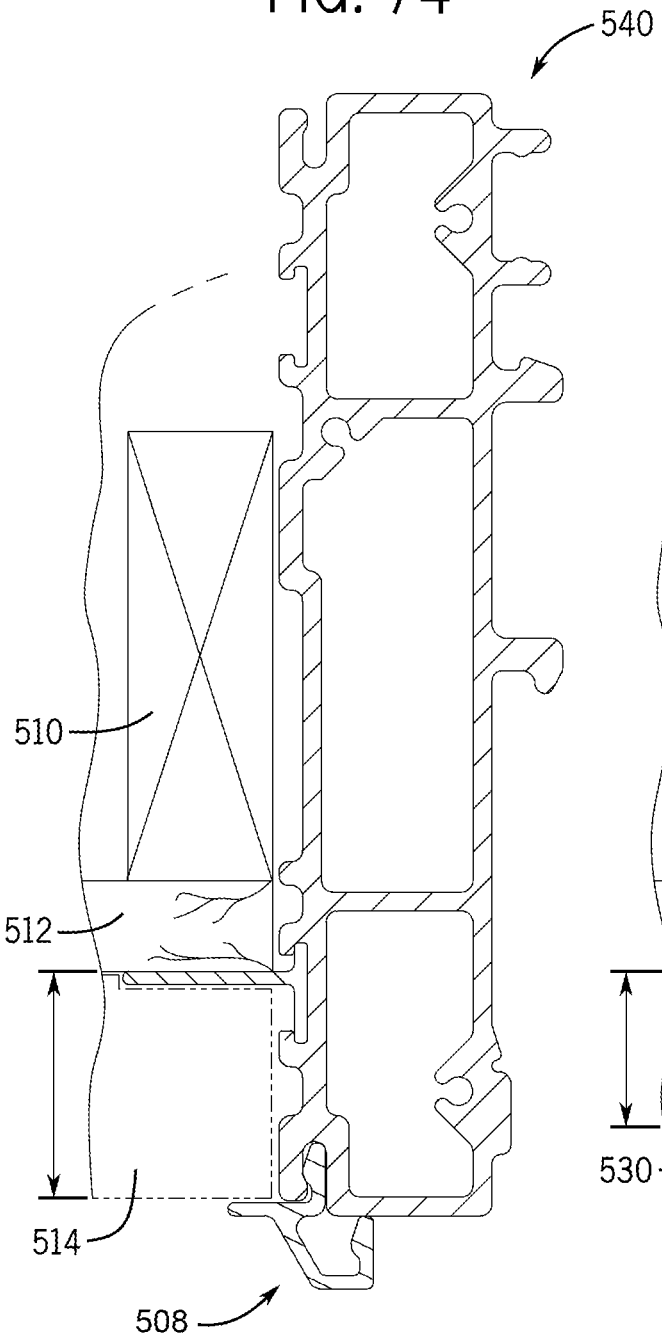
FIG. 74 is a cross section of another embodiment of a fenestration assembly with the first stucco key in a first orientation.
Figure 75:
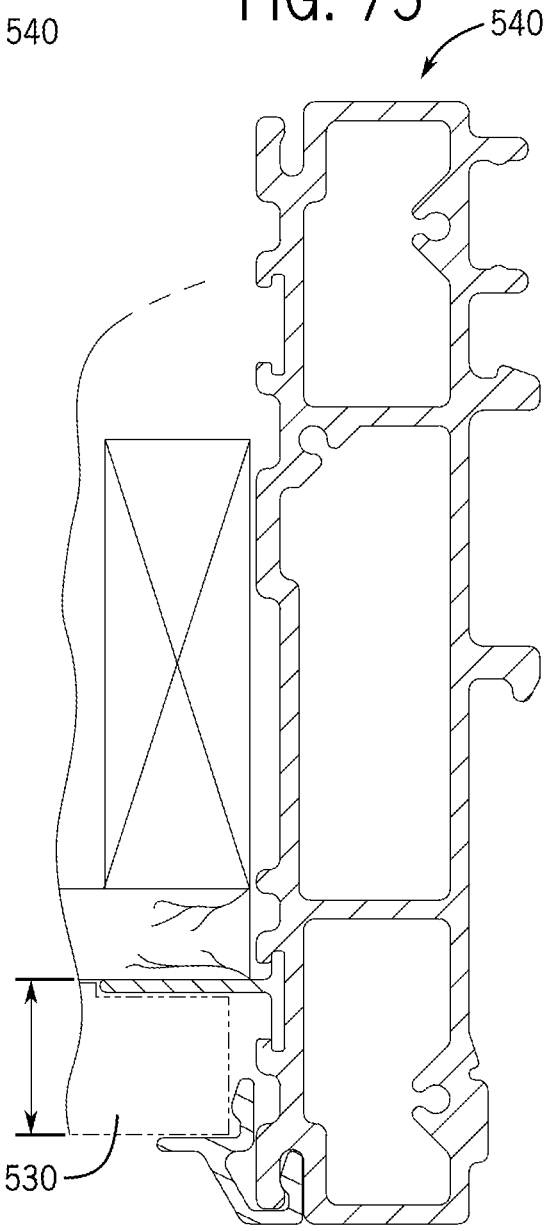
FIG. 75 is a cross section of the fenestration assembly of FIG. 74 with the first stucco key in a second orientation.

Referring to FIG. 74 and FIG. 75 stucco key 508 is shown in a first and second configuration with a different frame 540.

Figure 78:
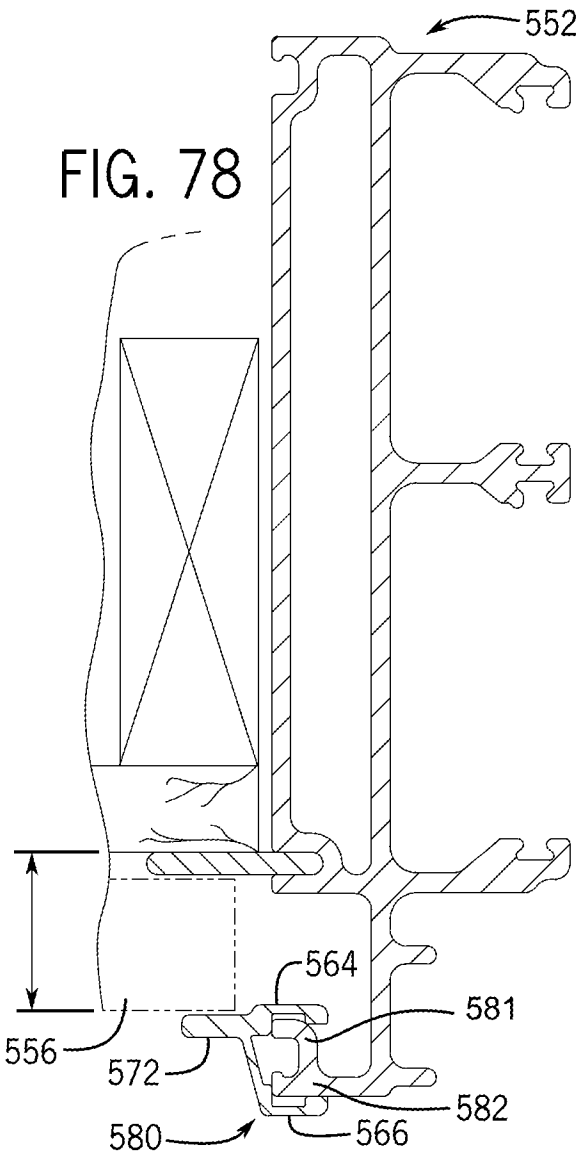
FIG. 78 is a cross section of a fenestration assembly with the second stucco key in a second orientation.
Figure 77:
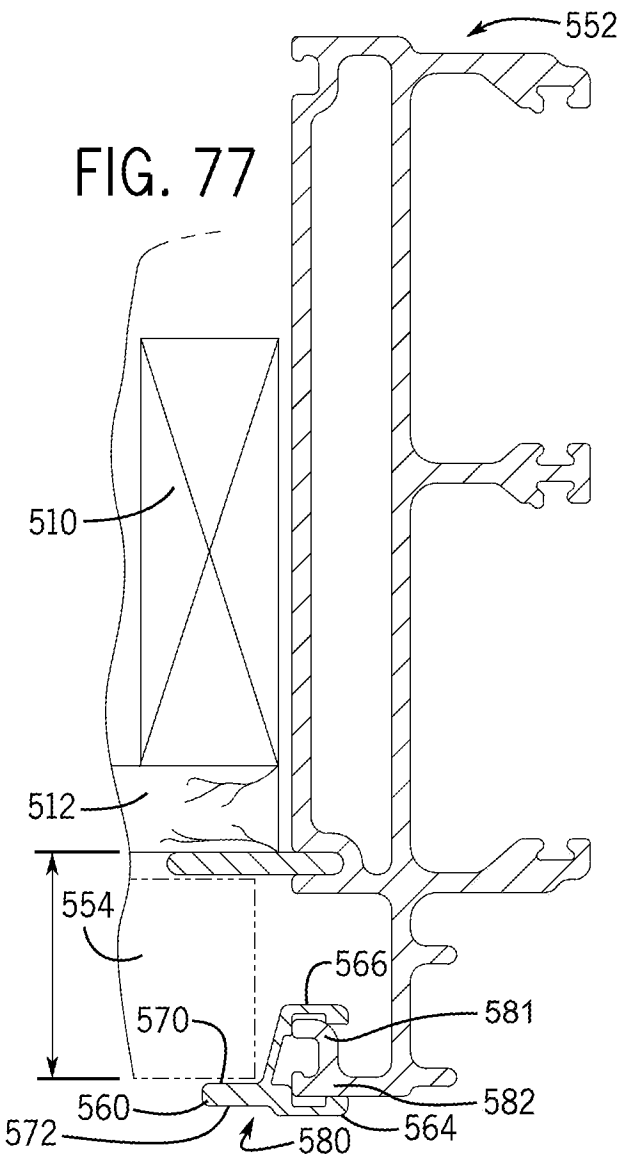
FIG. 77 is a cross section of a fenestration assembly with the second stucco key in a first orientation.
Figure 76:
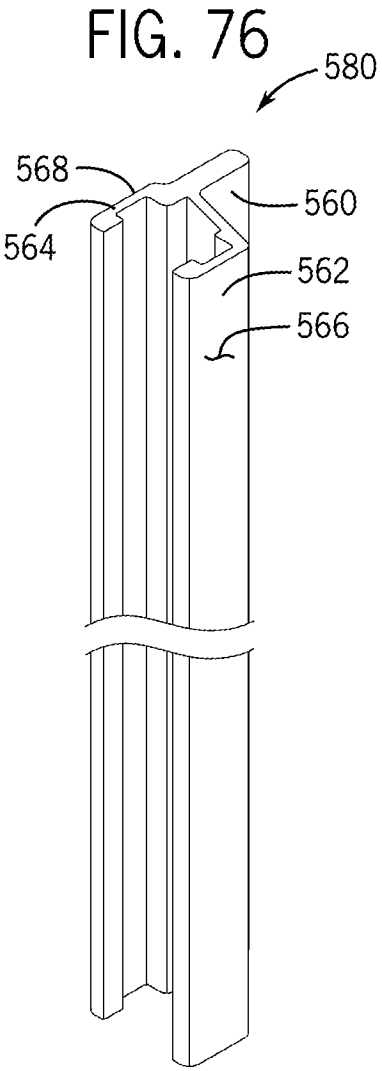
FIG. 76 is a second stucco key.

Referring to FIG. 76, FIG. 77 and FIG. 78 a reversible stucco key 580 includes a first leg 562 and a second leg 564. A lip 560 extends a first distance from first leg 562 and a second distance from second leg 564, where the first distance is greater than the second distance. Frame 552 includes an attachment structure having a first portion 581 and a second portion 582. Referring FIG. 77, when stucco key 580 is secured to frame 552 in a first configuration, leg 564 of stucco key 580 is adjacent portion 581 of frame 552 and second leg 566 of stucco key 580 is adjacent portion 582 of frame 552. In this first configuration, the inwardly facing surface 570 of lip 560 is first distance from building structure 510 and 512. In this first configuration, outwardly facing surface 572 of lip 560 is closely adjacent to the outwardly facing surface of frame 552.

Referring to FIG. 78, reversible stucco key 580 is secured to frame 552 in a second configuration such that the distance between lip 560 and the building structure is a second distance 556 that is less than the distance 554 in the first configuration. In the second configuration leg 556 is adjacent portion 581 and leg 566 is adjacent portion 582 of frame 552. In the second configuration the outwardly facing surface 572 of lip 560 is closer to the building than the outwardly facing surface 572 of lip 560 when the reversible stucco key is in the first configuration. However, in both the first and second configuration, the outermost portion of stucco key 580 relative to frame 552 is the same distance. In the first configuration the outermost portion of the stucco key 580 is leg 564, wherein in the second configuration the outermost portion of the stucco key 580 is leg 566.

It is important to note that the apparatus and methods as described herein are illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements and vice versa, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the exemplary embodiments without departing from the scope of the present inventions as expressed in the appended claims.

What is claimed is:

1. A fenestration trim assembly comprising:

a trim assembly including at least a first lineal having a profile and a sill having a profile;

a connector operatively coupling the first lineal to the sill, and including:

a first member operatively received within a hollow interior of the sill;

a cover operatively covering an opened end of the sill; and a second member being positioned adjacent the exterior portion of the sill and operatively received within the lineal, wherein the profile of the lineal is different from the profile of the sill wherein an entire terminal end of the first lineal contacts a surface of the sill;

wherein the second member extends away from the sill at an angle such that a mating surface of an outer portion of the lineal is biased toward a mating matting surface of the sill about a vector that is parallel to the longitudinal axis of the sill when the second member is fastened to the lineal.

2. The fenestration trim assembly of claim 1, wherein the second member is fastened to the lineal with a threaded fastener and the sill is threaded fastener free.

3. A fenestration trim assembly comprising:

a trim assembly member forming a frame including at least a first lineal member and a sill;

a first connector operatively coupling the first lineal member to the sill, and including a first leg operatively received within a hollow interior of the sill; and a cover operatively covering an opened end of the sill; and a second connector separate from the first connector and offset from a terminal end of the sill that is covered by the cover, the second connector having an extension operatively received within a hollow interior of the first lineal member, wherein the second connector can be positioned at a plurality of locations from the terminal end of the sill.

4. The trim assembly of claim 3, wherein the second connector can be positioned at any distance from the terminal end of the sill.

5. The trim assembly of claim 3, wherein the first lineal member and sill form a horn.

6. The trim assembly of claim 3, wherein the first lineal member and sill form a butt joint.

7. The trim assembly of claim 3, wherein the first lineal member and sill form a joint at an angle other than ninety degrees.

8. A fenestration trim assembly comprising:

a trim assembly including at least a first hollow lineal and a sill;

the first hollow lineal having an outwardly facing wall and an opposing inwardly facing wall, the outwardly facing wall including an outwardly facing surface and an opposing inner facing surface facing into the hollow interior;

a connector operatively coupling the first lineal to the sill, and including:

a first portion and a longitudinal connector extending therefrom and operatively received within a hollow interior of the sill;

a fastener extending through an opening in an inwardly facing wall of the first lineal into the longitudinal connector biasing an edge of the outwardly facing wall of the first lineal about a longitudinal axis of the sill into contact with the sill;

wherein the fastener extends perpendicular to a longitudinal axis of the sill.

9. The fenestration trim assembly of claim 8, wherein longitudinal connector has a longitudinal axis that is non-perpendicular with the longitudinal axis of the first lineal.

10. The fenestration trim assembly of claim 8, wherein the first portion of the connector forms an angle with inner facing surface facing the first lineal, when the first portion of the connector is within the hollow interior of the first hollow lineal.

11. The fenestration trim assembly of claim 8, wherein the connector includes a first leg operatively received within a hollow interior of the sill; and a cover portion operatively covering an open end of the sill.

12. The fenestration trim assembly of claim 8, wherein the connector includes a portion that contacts an inwardly facing surface of the sill.

13. The fenestration trim assembly of claim 8, wherein an entire free end of the first hollow lineal contacts an upper surface of the sill a spaced distance from a terminal end of the sill forming a horn.

* * * * *